US008761620B2

(12) United States Patent
Takeuchi

(10) Patent No.: US 8,761,620 B2
(45) Date of Patent: Jun. 24, 2014

(54) IMAGE FORMING APPARATUS, IMAGE FORMING METHOD, AND IMAGE FORMING SYSTEM

(75) Inventor: Tomokazu Takeuchi, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 191 days.

(21) Appl. No.: 13/396,956

(22) Filed: Feb. 15, 2012

(65) Prior Publication Data

US 2012/0213536 A1 Aug. 23, 2012

(30) Foreign Application Priority Data

Feb. 18, 2011 (JP) ..... 2011-033631
Jan. 11, 2012 (JP) ..... 2012-003534

(51) Int. Cl.
*G03G 15/16* (2006.01)
*G03G 13/16* (2006.01)

(52) U.S. Cl.
USPC ..... 399/45; 399/66

(58) Field of Classification Search
None
See application file for complete search history.

(56) References Cited

U.S. PATENT DOCUMENTS

2004/0114978 A1* 6/2004 Iwakura et al. ..... 399/388
2005/0280687 A1* 12/2005 Kurahashi ..... 347/139
2011/0181116 A1 7/2011 Takeuchi et al.

FOREIGN PATENT DOCUMENTS

JP 2005-351671 12/2005
JP 2006-267486 10/2006
JP 2006-267486 A * 10/2006 ..... G03G 15/16
JP 2007-304492 11/2007
JP 2008-65176 3/2008

* cited by examiner

*Primary Examiner* — Clayton E Laballe
*Assistant Examiner* — Jas Sanghera
(74) *Attorney, Agent, or Firm* — Oblon, Spivak, McClelland, Maier & Neustadt, L.L.P.

(57) ABSTRACT

An image forming apparatus includes a calculating unit configured to specify pieces of thickness information for calculation of a difference between thicknesses of a recording medium among pieces of thickness information each indicating thicknesses of the recording medium and calculate the difference using the specified pieces of thickness information, the pieces of thickness information being obtained as a detection result by sequentially detecting the thicknesses of the recording medium being conveyed; a determining unit configured to determine whether the calculated difference is equal to or larger than a first threshold; and a transfer unit configured to transfer an image onto the recording medium using at least an alternating-current voltage when the difference is equal to or larger than the first threshold.

10 Claims, 15 Drawing Sheets

| DIFFERENCES AMONG PAPER THICKNESSES | $V_{pp}$ |
|---|---|
| 0 | 0 (ONLY DIRECT CURRENT) |
| 0.1 | 1 kVpp |
| 0.2 | 2 kVpp |
| 0.3 | 3 kVpp |
| 0.4 | 4 kVpp |
| 0.5 | 5 kVpp |
| 0.6 | 6 kVpp |
| 0.7 | 7 kVpp |
| 0.8 | 8 kVpp |
| 0.9 | 9 kVpp |
| 1 | 10 kVpp |

IMAGE FORMING APPARATUS, IMAGE FORMING METHOD, AND IMAGE FORMING SYSTEM

CROSS-REFERENCE TO RELATED APPLICATIONS

The present application claims priority to and incorporates by reference the entire contents of Japanese Patent Application No. 2011-033631 filed in Japan on Feb. 18, 2011 and Japanese Patent Application No. 2012-003534 filed in Japan on Jan. 11, 2012.

BACKGROUND OF THE INVENTION

1. Field of the Invention

The present invention relates to an image forming apparatus, an image forming method, and an image forming system.

2. Description of the Related Art

An image forming apparatus of an electrophotographic system forms a charged latent image on a uniformly-charged image bearing member, develops the formed charged latent image with a toner to form a toner image, and transfers the formed toner image onto recording paper and fixing the toner image to thereby form an image on the recording paper.

Usually, recording paper has irregularities. A toner is less easily transferred to recesses compared with projections. Therefore, when an image is formed on recording paper having large irregularities, in some case, the toner is not transferred to recesses and density unevenness such as white voids occurs.

Therefore, for example, Japanese Patent Application Laid-open No. 2007-304492 discloses a technology for specifying, from a difference between current values of electric currents flowing through two metal roller pairs, irregularities of recording paper that passes through the two metal roller pairs and controlling a toner adhesion amount to be an adhesion amount suitable for the specified irregularities.

However, in the related art, although an amount of a toner deposited on a recording medium can be set to an amount suitable for the irregularities, a toner transfer ratio to the recording medium is not improved. Therefore, density unevenness of an image cannot be reduced.

Therefore, there is a need for an apparatus capable of an image forming apparatus, an image forming method, and an image forming system that can reduce density unevenness of an image even when the image is formed on a recording medium having irregularities.

SUMMARY OF THE INVENTION

It is an object of the present invention to at least partially solve the problems in the conventional technology.

According to an embodiment, there is provided an apparatus that includes an image forming apparatus that includes a calculating unit configured to specify pieces of thickness information for calculation of a difference between thicknesses of a recording medium among pieces of thickness information each indicating thicknesses of the recording medium and calculate the difference using the specified pieces of thickness information, the pieces of thickness information being obtained as a detection result by sequentially detecting the thicknesses of the recording medium being conveyed; a determining unit configured to determine whether the calculated difference is equal to or larger than a first threshold; and a transfer unit configured to transfer an image onto the recording medium using at least an alternating-current voltage when the difference is equal to or larger than the first threshold.

According to another embodiment, there is provided an image forming method that includes specifying, by a calculating unit, pieces of thickness information for calculation of a difference between thicknesses of a recording medium among pieces of thickness information each indicating thicknesses of the recording medium; calculating, by the calculating unit, the difference using the specified pieces of thickness information, the pieces of thickness information being obtained as a detection result by sequentially detecting the thicknesses of the recording medium being conveyed; determining, by a determining unit, whether the calculated difference is equal to or larger than a first threshold; and transferring, by a transfer unit, an image onto the recording medium using at least an alternating-current voltage when the difference is equal to or larger than the first threshold.

According to still another embodiment, there is provided an image forming system that includes an image forming apparatus; a calculating unit configured to specify pieces of thickness information for calculation of a difference between thicknesses of a recording medium among pieces of thickness information each indicating thicknesses of the recording medium and calculate the difference using the specified pieces of thickness information, the pieces of thickness information being obtained as a detection result by sequentially detecting the thicknesses of the recording medium being conveyed in the image forming apparatus; and a determining unit configured to determine whether the calculated difference is equal to or larger than a first threshold. The image forming apparatus includes a transfer unit configured to transfer an image onto the recording medium using at least an alternating-current voltage when the difference is equal to or larger than the first threshold.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of an image forming apparatus, an image forming method, and an image forming system according to the present invention are explained in detail with reference to the accompanying drawings. In an example explained in the embodiments, the image forming apparatus according the present invention is applied to a color printing apparatus of an electrophotographic system and, specifically, a printing apparatus that superimposes color component images of four colors of yellow (Y), magenta (M), cyan (C), and black (K) one top of another on recording paper to form an image. However, the image forming apparatus is not limited to this example. The image forming apparatus according to the present invention can be applied to any apparatus that forms an image in the electrophotographic system irrespective of whether the apparatus is a color apparatus or a monochrome apparatus. The image forming apparatus according to the present invention can also be applied to, for example, a copying machine and a multifunction peripheral (MFP) of the electrophotographic system. The multifunction peripheral is an apparatus including at least two functions among a printing function, a copying function, a scanner function, and a facsimile function.

First Embodiment

First, the configuration of a printing apparatus according to a first embodiment is explained.

Figure 1:
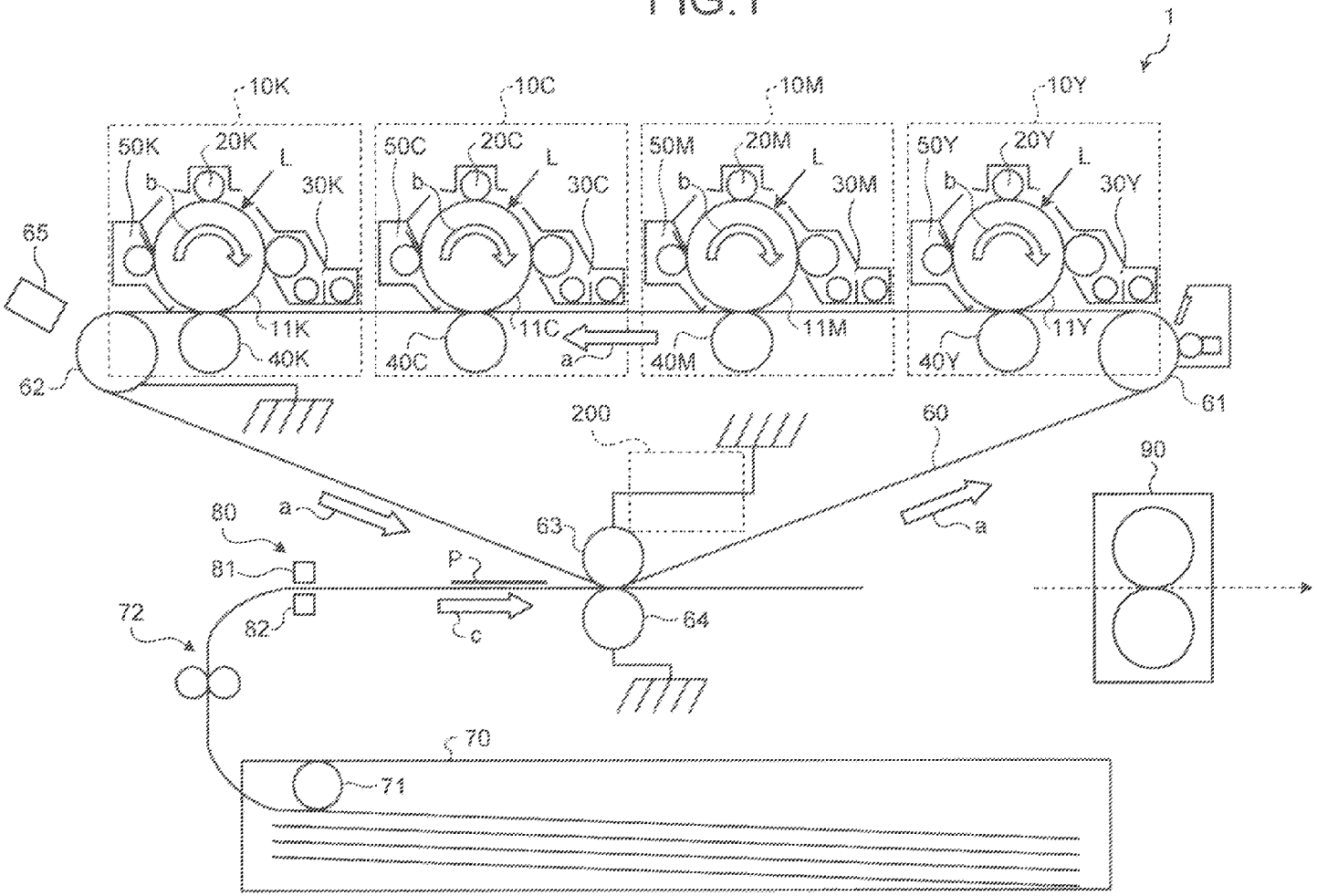
FIG. 1 is a mechanical configuration diagram of an example of a printing apparatus according to a first embodiment.

FIG. 1 is a mechanical configuration diagram of an example of a printing apparatus 1 according to the first embodiment. As shown in FIG. 1, the printing apparatus 1 includes image forming units 10Y, 10M, 100 and 10K, an intermediate transfer belt 60, supporting rollers 61 and 62, a secondary-transfer-unit opposed roller 63, a secondary transfer roller 64, a surface potential sensor 65, a sheet cassette 70, a paper feeding roller 71, a conveying roller pair 72, a paper thickness sensor 80, a fixing device 90, and a secondary transfer power supply 200.

As shown in FIG. 1, the image forming units 10Y, 10M, 100, and 10K are arranged along the intermediate transfer belt 60 in the order of the image forming units 10Y, 10M, 10C, and 10K from an upstream side in a moving direction of the intermediate transfer belt 60 (an arrow "a" direction).

Figure 2:
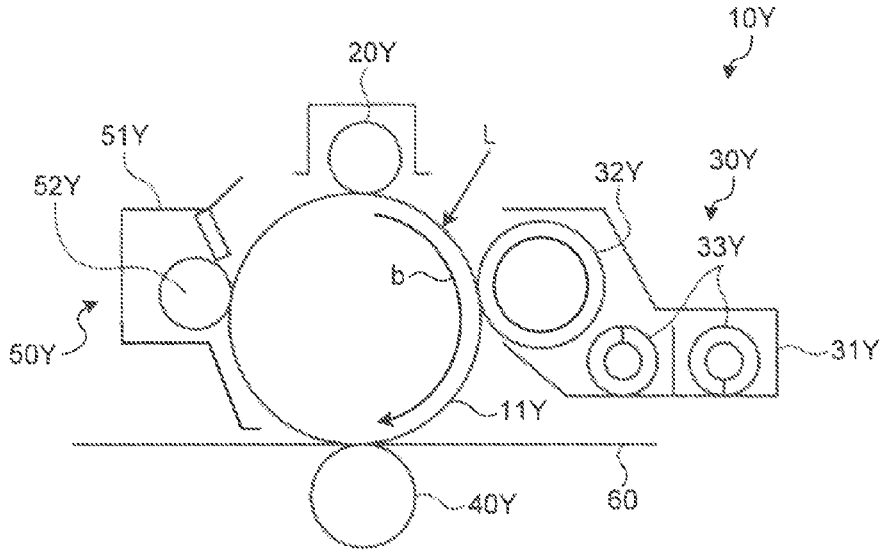
FIG. 2 is a mechanical configuration diagram of an example of an image forming unit according to the first embodiment.

FIG. 2 is a mechanical configuration diagram of an example of the image forming unit 10Y according to the first embodiment. As shown in FIG. 2, the image forming unit 10Y includes a photosensitive drum 11Y, a charging device 20Y, a developing device 30Y, a primary transfer roller 40Y, and a cleaning device 50Y. The image forming unit 10Y and a not-shown irradiating device perform an image forming process (a charging step, an irradiating step, a developing step, a transfer step, and a cleaning step) on the photosensitive drum 11Y to thereby form a color component image (a toner image) of yellow on the photosensitive drum 11Y and transfers the color component image onto the intermediate transfer belt 60.

All the image forming units 10M, 100, and 10K include components common to the image forming unit 10Y. The image forming unit 10M performs the image forming process to thereby form a color component image (a toner image) of magenta. The image forming unit 10C performs the image forming process to thereby form a color component image (a toner image) of cyan. The image forming unit 10K performs the image forming process to thereby form a color component image (a toner image) of black. Therefore, the components of the image forming unit 10Y are mainly explained below. Concerning the components of the image forming units 10M, 10C, and 10K, M, C, and K are merely affixed to reference numerals and signs instead of Y affixed to the reference numerals and signs of the components of the image forming unit 10Y (see FIG. 1). Explanation of the components of the image forming units 10M, 10C, and 10K is omitted.

The photosensitive drum 11Y is an image bearing member and is driven to rotate in an arrow "b" direction by a not-shown photosensitive-drum driving device. The photosensitive drum 11Y is, for example, an organic photosensitive member having an outer diameter of 60 millimeters. The photosensitive drums 11M, 11C, and 11K are also driven to rotate in the arrow "b" direction by the not-shown photosensitive-drum driving device.

The photosensitive drum 11K for black and the photosensitive drums 11Y, 11M, and 11C for colors can be configured to be capable of being driven to rotate independently from each other. This makes it possible to drive to rotate only the photosensitive drum 11K for black when a monochrome image is formed and simultaneously drive to rotate the photosensitive drums 11Y, 11M, 11C, and 11K when a color image is formed.

First, in the charging step, the charging device 20Y charges the surface of the photosensitive drum 11Y driven to rotate. Specifically, the charging device 20Y applies a voltage obtained by superimposing an alternating-current voltage on a direct-current voltage to a charging roller (not shown), which is, for example, a conductive elastic member having a roller shape. Consequently, the charging device 20Y directly causes electric discharge between the charging roller and the photosensitive drum 11Y and charges the photosensitive drum 11Y to a predetermined polarity, for example, a minus polarity.

Subsequently, in the irradiating step, the not-shown irradiating device irradiates an optically-modulated laser beam L on a charged surface of the photosensitive drum 11Y and forms an electrostatic latent image corresponding to a color component image of yellow on the surface of the photosensitive drum 11Y. As a result, a section where an absolute value of potential falls in a surface section of the photosensitive drum 11Y on which the laser beam L is irradiated changes to an electrostatic latent image (an image section). A section where the laser beam L is not irradiated and an absolute value of potential is kept high changes to a background section.

Subsequently, in the developing step, the developing device 30Y develops the electrostatic latent image formed on the photosensitive drum 11Y with a yellow toner and forms a yellow toner image on the photosensitive drum 11Y.

The developing device 30Y includes a storage container 31Y, a developing sleeve 32Y stored in the storage container 31Y, and screw members 33Y stored in the storage container 31Y. In the storage container 31Y, a two-component developer including yellow toner and carrier particles is stored. The developing sleeve 32Y is a developer carrying member and is arranged to be opposed to the photosensitive drum 11Y via an opening of the storage container 31Y. The screw members 33Y are agitating members that convey the developer while agitating the developer. The screw members 33Y are arranged on a supply side of the developer, which is the developing sleeve side, and a receiving side where the supply of the developer is received from a not-shown toner supply device. The screw members 33Y are rotatably supported in the storage container 31Y by not-shown bearing members.

Subsequently, in the transfer step, the primary transfer roller 40Y transfers the yellow toner image formed on the photosensitive drum 11Y onto the intermediate transfer belt 60. A small amount of an un-transferred toner remains on the photosensitive drum 11Y even after the transfer of the toner image.

The primary transfer roller 40Y is, for example, an elastic roller including a conductive sponge layer and is arranged to be pressed against the photosensitive drum 11Y from the rear surface of the intermediate transfer belt 60. A bias subjected to constant current control is applied to the elastic roller as a primary transfer bias. The primary transfer roller 40Y has, for example, an outer diameter of 16 millimeters and a core bar diameter of 10 millimeters. A value of resistance R of a sponge layer in the primary transfer roller 40Y is about $3\times10^7$ ohms. The value of the resistance R of the sponge layer is a value calculated using the Ohm's law (R=V/I) from an electric current I flowing when a voltage V of 1000 volts is applied to the core bar of the primary transfer roller 40Y in a state in which a grounded metal roller having an outer diameter of 30 millimeters is pressed against the primary transfer roller 40Y at 10 newtons.

Subsequently, in the cleaning step, the cleaning device 50Y wipes out the un-transferred toner remaining on the photosensitive drum 11Y. The cleaning device 50Y includes a cleaning blade 51Y and a cleaning brush 52Y. The cleaning blade 51Y cleans the surface of the photosensitive drum 11Y in a state in which the cleaning blade 51Y is in contact with the photosensitive drum 11Y from a counter direction with respect to a rotating direction of the photosensitive drum 11Y. The cleaning brush 52Y cleans the surface of the photosensitive drum 11Y in a state in which the cleaning brush 52Y is in contact with the photosensitive drum 11Y while rotating in the opposite direction of the rotating direction of the photosensitive drum 11Y.

Referring back to FIG. 1, the intermediate transfer belt 60 is an endless belt wound around a plurality of rollers such as the supporting rollers 61 and 62 and the secondary-transfer-unit opposed roller 63. When one of the supporting rollers 61 and 62 is driven to rotate, the intermediate transfer belt 60 moves in the arrow "a" direction. First, the yellow toner image is transferred onto the intermediate transfer belt 60 by the image forming unit 10Y. Subsequently, a magenta toner image, a cyan toner image, and a black toner image are sequentially transferred to be superimposed one on top of another by the image forming unit 10M, the image forming unit 10C, and the image forming unit 10K. Consequently, a full-color toner image is formed on the intermediate transfer belt 60. The intermediate transfer belt 60 carries the formed full-color image to between the secondary-transfer-unit opposed roller 63 and the secondary transfer roller 64. The intermediate transfer belt 60 is formed of, for example, endless carbon dispersed polyimide resin having thickness of 60 micrometers and volume resistivity of about $1\times10^9$ Ωcm (a measurement value at an applied voltage of 100 volts by Hiresta UP MCP HT450 manufactured by Mitsubishi Chemical Corporation). The supporting roller 62 is grounded.

The surface potential sensor 65 (e.g., EFS-22D manufactured by TDK Corporation) is arranged in a position about 4 millimeters apart from the intermediate transfer belt 60 to be opposed to the supporting roller 62. The surface potential sensor 65 measures surface potential of a toner layer when the toner image transferred onto the intermediate transfer belt 60 passes the supporting roller 62.

In the sheet cassette 70, a plurality of pieces of recording paper are stored one on top of another. In this embodiment, the recording paper is assumed to be rezak paper having large irregularities but is not limited to the rezak paper.

The paper feeding roller 71 is set in contact with recording paper P located at the top of the sheet cassette 70 and feeds the recording paper P with which the paper feeding roller 71 is in contact.

The conveying roller pair 72 (an example of a conveying unit) conveys the recoding paper P (an example of a recoding medium), which is fed by the paper feeding roller 71, to between the secondary-transfer-unit opposed roller 63 and the secondary transfer roller 64 (in an arrow "c" direction) at predetermined timing.

The paper thickness sensor 80 sequentially detects the paper thicknesses of pieces of the recording paper P being conveyed by the conveying roller pair 72. The paper thickness sensor 80 detects the paper thickness of the recording paper P being conveyed by the conveying roller pair 72 before the leading end of the recording paper P reaches the secondary-transfer-unit opposed roller 63 and the secondary transfer roller 64.

Figure 3:
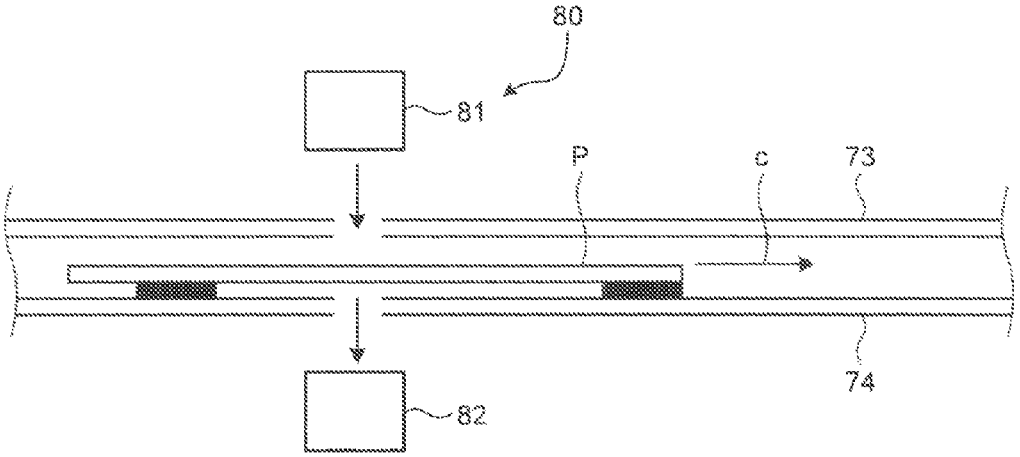
FIG. 3 is a mechanical configuration diagram of an example of a paper thickness sensor according to the first embodiment.

FIG. 3 is a mechanical configuration diagram of an example of the paper thickness sensor 80 according to the first embodiment. As shown in FIG. 3, the paper thickness sensor 80 is a transmission-type sensor and includes a light emitting diode 81 arranged above an upper guide plate 73 of a recording paper conveying path and a light receiving element 82 arranged under a lower guide plate 74 of the recording paper conveying path. The light emitting diode 81 emits light to the light receiving element 82 at a predetermined period when the recording paper P passes between the light emitting diode 81 and the light receiving element 82. The light receiving element 82 detects, every time the light is emitted from the light emitting diode 81, a light amount of the light emitted from the light emitting diode 81 and passed through the recording paper P. Consequently, the light receiving element 82 sequentially detects the paper thicknesses of pieces of the recording paper P and sequentially outputs signals (voltages) corresponding to the paper thicknesses. It is assumed that the light receiving element 82 outputs a lower value (voltage) as the paper thickness is larger. In the example explained in this embodiment, the paper thickness sensor 80 detects paper thickness in an optical system. However, the paper thickness sensor 80 is not limited to this example. The paper thickness sensor 80 can detect paper thickness in an ultrasonic system. In this case, the paper thickness sensor 80 includes a transmitter that transmits ultrasound and a receiver that receives the ultrasound. The receiver detects the ultrasound transmitted from the transmitter and passed through the recording paper P to thereby detect the paper thickness of the recording paper P and outputs a signal corresponding to the paper thickness.

Referring back to FIG. 1, a secondary transfer nip (not shown) formed between the secondary-transfer-unit opposed roller 63 and the secondary transfer roller 64 collectively transfers the full-color toner image carried by the intermediate transfer belt 60 onto the recording paper P conveyed by the conveying roller pair 72.

The secondary-transfer-unit opposed roller 63 is, for example, a conductive NBR rubber layer having an outer diameter of 24 millimeters and a core bar diameter of 16 millimeters. A value of resistance R of the conductive NBR rubber layer is about $4\times10^7$ ohms according to a measuring method same as the measuring method for the primary transfer roller 40Y. The secondary transfer roller 64 is, for example, a conductive NBR rubber layer having an outer diameter of 24 millimeters and a core bar diameter of 14 millimeters. A value of resistance R of the conductive NBR rubber layer is equal to or lower than about $1\times10^6$ ohms according to a measuring method same as the measuring method for the primary transfer roller 40Y.

The secondary transfer power supply 200 for transfer bias is connected to the secondary-transfer-unit opposed roller 63 (an example of a transfer unit). The secondary transfer power supply 200 applies a voltage to the secondary-transfer-unit opposed roller 63 when the secondary transfer nip transfers the full-color toner image onto the recording paper P. Specifically, the secondary transfer power supply 200 applies only the direct-current voltage to the secondary-transfer-unit opposed roller 63 and applies a voltage obtained by superimposing the direct-current voltage and the alternating-current voltage to the secondary-transfer-unit opposed roller 63 according to the paper thickness of the recording paper P detected by the paper thickness sensor 80. Consequently, a potential difference occurs between the secondary-transfer-unit opposed roller 63 and the secondary transfer roller 64 and a voltage for directing the full-color toner from the intermediate transfer belt 60 to the recording paper P side is generated. Therefore, the full-color toner image can be transferred onto the recording paper P. The potential difference in this embodiment is represented as (the potential of the secondary-transfer-unit opposed roller 63)—(the potential of the secondary transfer roller 64).

The fixing device 90 heats and presses the recording paper P having the full-color toner image transferred thereon to thereby fix the full-color toner image on the recording paper P. The recording paper P having the full-color toner image fixed thereon is discharged to the outside of the printing apparatus 1.

Figure 4:
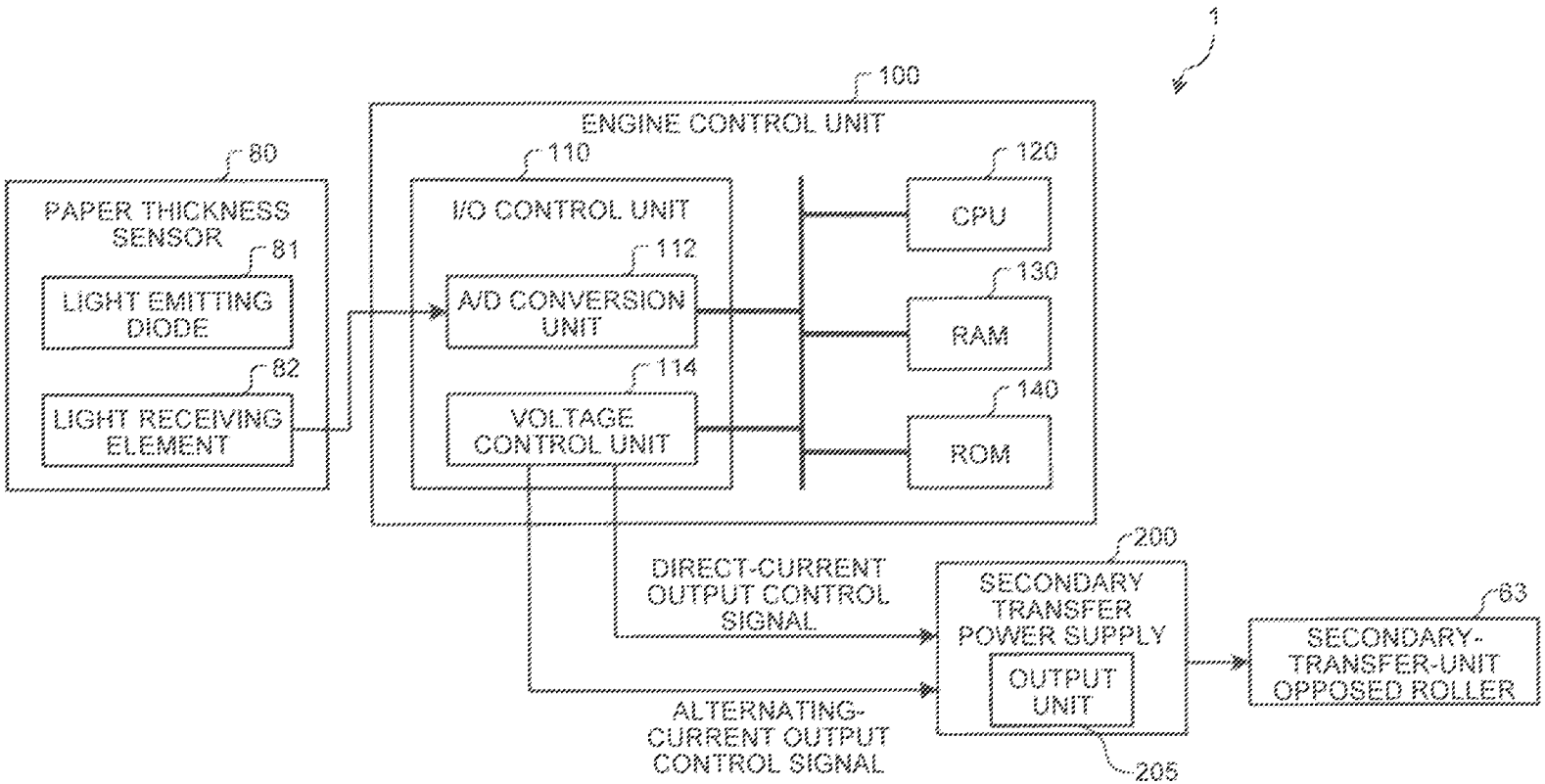
FIG. 4 is a block diagram of an example of an electrical configuration of the printing apparatus according to the first embodiment.

FIG. 4 is a block diagram of an example of an electrical configuration of the printing apparatus 1 according to the first embodiment. As shown in FIG. 4, the printing apparatus 1 includes the paper thickness sensor 80, an engine control unit 100, the secondary transfer power supply 200, and the secondary-transfer-unit opposed roller 63.

The paper thickness sensor 80 includes the light emitting diode 81 and the light receiving element 82. The paper thickness sensor 80 sequentially detects the paper thicknesses of pieces of recording paper and sequentially outputs paper thickness signals corresponding to the detected paper thicknesses to the engine control unit 100. Specifically, the light receiving element 82 detects a light amount of light emitted from the light emitting diode 81 and transmitted through the recording paper P to thereby detect the paper thickness of the recording paper P and outputs a paper thickness signal corresponding to the paper thickness to the engine control unit 100.

The engine control unit 100 performs engine control, for example, control related to image formation. The engine control unit 100 includes an I/O control unit 110, a central processing unit (CPU) 120, a random access memory (RAM) 130, and a read only memory (ROM) 140.

The I/O control unit 110 controls input and output of various signals and includes an A/D conversion unit 112 and a voltage control unit 114. The A/D conversion unit 112 converts an analog paper thickness signal input from the paper thickness sensor 80 (the light receiving element 82) into a digital paper thickness signal. The voltage control unit 114 is explained later.

The CPU 120 acquires the digital paper thickness signal from the I/O control unit 110 and calculates a difference among the paper thicknesses of recording paper, i.e., the sizes of irregularities. When the calculated difference among the paper thicknesses is smaller than a first threshold, the CPU 120 instructs the voltage control unit 114 to cause the secondary transfer power supply 200 to perform a high voltage output only at the direct-current voltage. When the calculated difference among the paper thicknesses is equal to or larger than the first threshold, the CPU 120 instructs the voltage control unit 114 to cause the secondary transfer power supply 200 to perform a high voltage output at the voltage obtained by superimposing the alternating-current voltage on the direct-current voltage. The CPU 120 performs the processing explained above using the RAM 130 as a work area.

Figure 5:
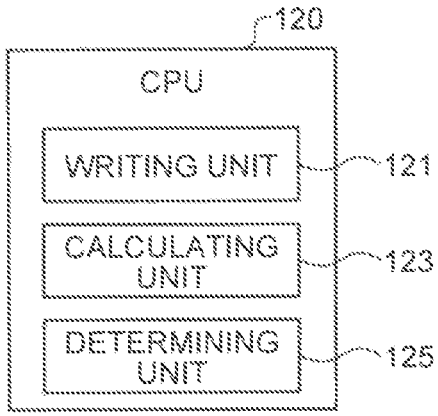
FIG. 5 is a block diagram of an example of a detailed configuration of a central processing unit (CPU) according to the first embodiment.

FIG. 5 is a block diagram of an example of a detailed configuration of the CPU 120 according to the first embodiment. As shown in FIG. 5, the CPU 120 includes a writing unit 121, a calculating unit 123, and a determining unit 125.

The writing unit 121 writes, every time the CPU 120 acquires the digital paper thickness signal from the A/D conversion unit 112, a value indicated by the acquired paper thickness signal in the RAM 130 as paper thickness information (an example of thickness information).

The calculating unit 123 specifies paper thickness information for calculation of a difference among paper thicknesses out of pieces of the paper thickness information written in the RAM 130 and calculates a difference among paper thicknesses using the specified paper thickness information. Specifically, the calculating unit 123 specifies a maximum and a minimum as the paper thickness information for calculation of a difference among paper thicknesses out of pieces of the paper thickness information written in the RAM 130 and calculates a difference between the specified maximum and the specified minimum as a difference among paper thicknesses.

The determining unit 125 determines whether the difference among the paper thicknesses calculated by the calculating unit 123 is equal to or larger than the first threshold. When the difference among the paper thicknesses is smaller than the first threshold, the determining unit 125 instructs the voltage control unit 114 to cause the secondary transfer power supply 200 to perform a high voltage output only at the direct-current voltage. When the difference among the paper thicknesses is equal to or larger than the first threshold, the determining unit 125 instructs the voltage control unit 114 to cause the secondary transfer power supply 200 to perform a high voltage output at the voltage obtained by superimposing the alternating-current voltage on the direct-current voltage.

The RAM 130 is a volatile storage device (memory) and is used as a work area of the CPU 120 and the like.

The ROM 140 is a nonvolatile read-only storage device (memory) and has stored therein, for example, various computer programs executed by the printing apparatus 1 and data used for various kinds of processing executed by the printing apparatus 1. For example, the ROM 140 stores direct-current output control data for instructing the secondary transfer power supply 200 to output the direct-current voltage and alternating-current output control data for instructing the secondary transfer power supply 200 to output the alternating-current voltage.

When the voltage control unit 114 is instructed by the CPU 120 to perform a high voltage output only at the direct-current voltage, the voltage control unit 114 outputs a direct-current output control signal based on the direct-current output control data stored in the ROM 140 to the secondary transfer power supply 200. When the voltage control unit 114 is instructed by the CPU 120 to perform a high voltage output at the voltage obtained by superimposing the alternating-current voltage on the direct-current voltage, the voltage control unit 114 outputs the direct-current output control signal and an alternating-current output control signal based on the alternating-current output control data stored in the ROM 140 to the secondary transfer power supply 200.

The secondary transfer power supply 200 includes an output unit 205. When the direct-current output control signal is input from the voltage control unit 114, the output unit 205 performs a high voltage output to the secondary-transfer-unit opposed roller 63 only at the direct-current voltage and applies a voltage to the secondary-transfer-unit opposed roller 63. When the direct-current output control signal and the alternating-current output control signal are input from the voltage control unit 114, the secondary transfer power supply 200 performs a high voltage output to the secondary-transfer-unit opposed roller 63 at the voltage obtained by superimposing the alternating-current voltage on the direct-current voltage and applies a voltage to the secondary-transfer-unit opposed roller 63.

Figure 6:
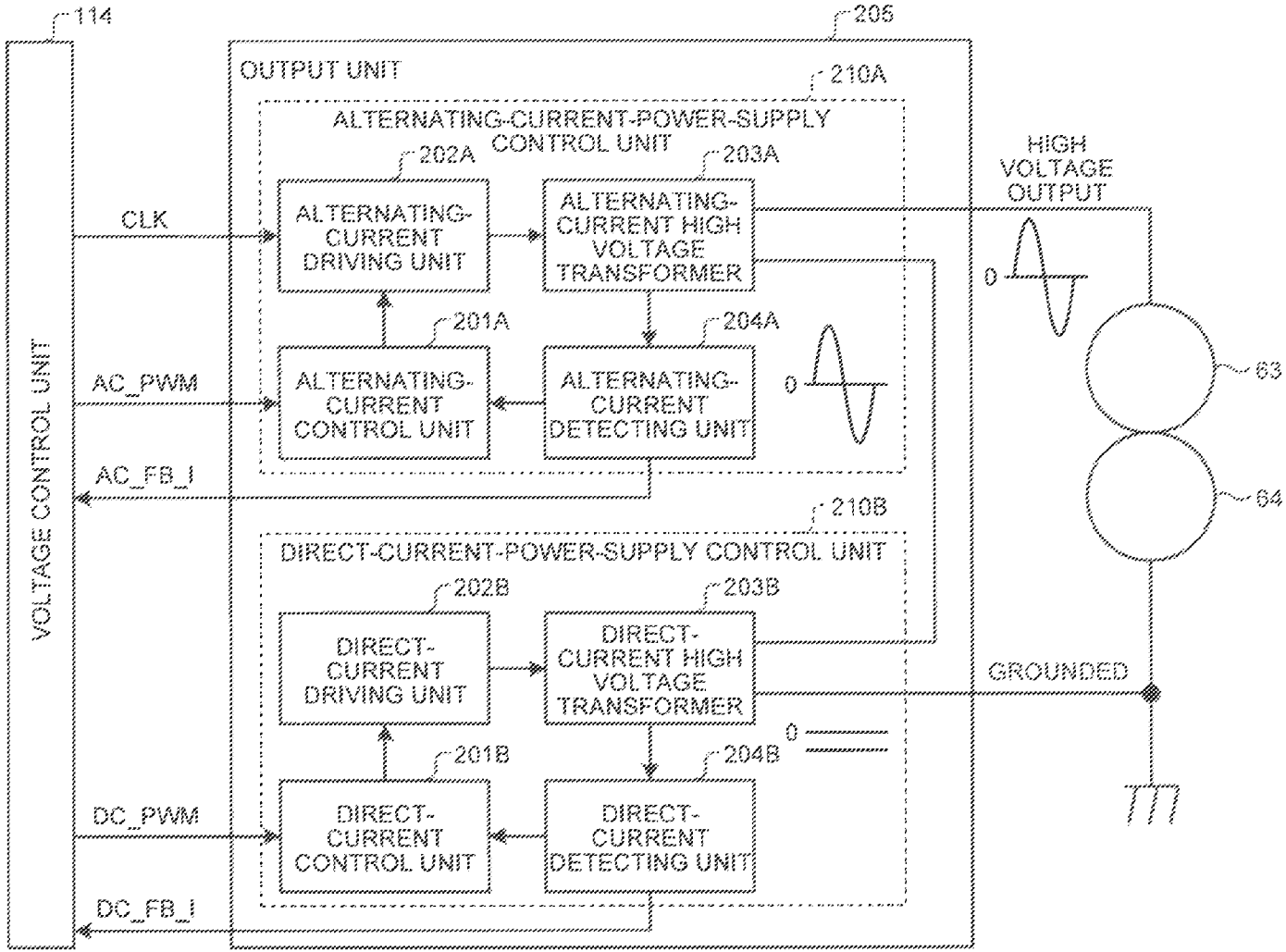
FIG. 6 is a block diagram of an example of an electrical configuration of an output unit according to the first embodiment.

FIG. 6 is a block diagram of an example of an electrical configuration of the output unit 205 according to the first embodiment. As shown in FIG. 6, the output unit 205 includes an alternating-current-power-supply control unit 210A and a direct-current-power-supply control unit 210B. The alternating-current-power-supply control unit 210A includes an alternating-current control unit 201A, an alternating-current driving unit 202A, an alternating-current high voltage transformer 203A, and an alternating-current detecting unit 204A. The direct-current-power-supply control unit 210B includes a direct-current control unit 201B, a direct-current driving unit 202B, a direct-current high voltage transformer 203B, and a direct-current detecting unit 204B. In the example shown in FIG. 6, a power supply input used for the operation of the secondary transfer power supply 200 is not shown.

An AC_PWM signal (an alternating-current output control signal) for setting an electric current or a voltage of an alternating-current high voltage output of the alternating-current high voltage transformer 203A is input to the alternating-current control unit 201A from the voltage control unit 114. An output current value and an output voltage value of an alternating-current high voltage output of the alternating-current high voltage transformer 203A detected by the alternating-current detecting unit 204A is input to the alternating-current control unit 201A from the alternating-current detecting unit 204A. The alternating-current control unit 201A controls driving of the alternating-current high voltage transformer 203A via the alternating-current driving unit 202A at the electric current and the voltage indicated by the input AC_PWM signal such that the input output current value reaches a predetermined value.

A CLK signal for setting a frequency of the alternating-current voltage of the secondary transfer power supply 200 is input to the alternating-current driving unit 202A from the voltage control unit 114. The alternating-current driving unit 202A drives the alternating-current high voltage transformer 203A according to the input CLK signal and control from the alternating-current control unit 201A. Rather than indicating a frequency of the alternating-current voltage of the secondary transfer power supply 200 to the alternating-current driving unit 202A according to the CLK signal from the voltage control unit 114, the alternating-current driving unit 202A can use a fixed frequency prepared in advance.

The alternating-current high voltage transformer 203A is driven by the alternating-current driving unit 202A, transforms the alternating-current voltage from the secondary transfer power supply 200, and performs an alternating-current high voltage output. The alternating-current high voltage transformer 203A performs a high-voltage output obtained by superimposing a direct-current high voltage output and an alternating-current high voltage output from the direct-current high voltage transformer 203B.

The alternating-current detecting unit 204A detects an output current value and an output voltage value of the alternating-current high voltage output of the alternating-current high voltage transformer 203A and outputs the output current value and the output voltage value to the alternating-current control unit 201A. The alternating-current detecting unit 204A outputs the detected output current value and the detected output voltage value to the voltage control unit 114 as an AC_FB_I signal. This is for the purpose of monitoring a load state in the engine control unit 100.

The alternating-current detecting unit 204A detects the output current value and the output voltage value to enable the alternating-current control unit 201A to perform both constant current control and constant voltage control for the alternating-current high voltage output of the alternating-current high voltage transformer 203A. However, in this embodiment, the alternating-current control unit 201A gives preference to the constant current control over the constant voltage control and usually performs the constant current control using the output current value. In this embodiment, the output voltage value is used to suppress an upper limit voltage of the alternating-current high voltage output of the alternating-current high voltage transformer 203A. The alternating-current control unit 201A controls a highest voltage in a no-load state and the like using the output voltage value.

A DC_PWM signal (a direct-current output control signal) for setting an electric current or a voltage of the direct-current high voltage output of the direct-current high voltage transformer 203B is input to the direct-current control unit 201B from the voltage control unit 114. The output current value and the output voltage value of the direct-current high voltage output of the direct-current high voltage transformer 203B detected by the direct-current detecting unit 204B is input to the direct-current control unit 201B from the direct-current detecting unit 204B. The direct-current control unit 201B controls driving of the direct-current high voltage transformer 203B via the direct-current driving unit 202B at the electric current and the voltage indicated by the input DC_PWM signal such that the input output current value reaches a predetermined value.

The direct-current driving unit 202B drives the direct-current high voltage transformer 203B according to the control by the direct-current control unit 201B.

The direct-current high voltage transformer 203B is driven by the direct-current driving unit 202B, transforms the direct-current voltage from the secondary transfer power supply 200, and performs a direct-current high voltage output.

The direct-current detecting unit 204B detects an output current value and an output voltage value of the direct-current high voltage output of the direct-current high voltage transformer 203B and outputs the output current value and the output voltage value to the direct-current control unit 201B. The direct-current detecting unit 204B outputs the detected output current value and the detected output voltage value to the voltage control unit 114 as a DC_FB_I signal. This is for the purpose of monitoring a load state in the engine control unit 100.

The direct-current detecting unit 204B detects the output current value and the output voltage value to enable the direct-current control unit 201B to perform both constant current control and constant voltage control for the direct-current high voltage output of the direct-current high voltage transformer 203B. However, in this embodiment, the direct-current control unit 201B gives preference to the constant current control over the constant voltage control and usually performs the constant current control using the output current value. In this embodiment, the output voltage value is used to suppress an upper limit voltage of the direct-current high voltage output of the direct-current high voltage transformer 203B. The direct-current control unit 201B controls a highest voltage in a no-load state and the like using the output voltage value.

In the example explained above, a high voltage output obtained by superimposing a direct current and an alternating current is performed only by the secondary transfer power supply 200. However, because it is difficult to form a power supply itself when a voltage level is high, the high voltage output obtained by superimposing the direct current and the alternating current can be performed in a system for switching a direct-current power supply and an alternating-current power supply with a relay can be performed.

Figure 7:
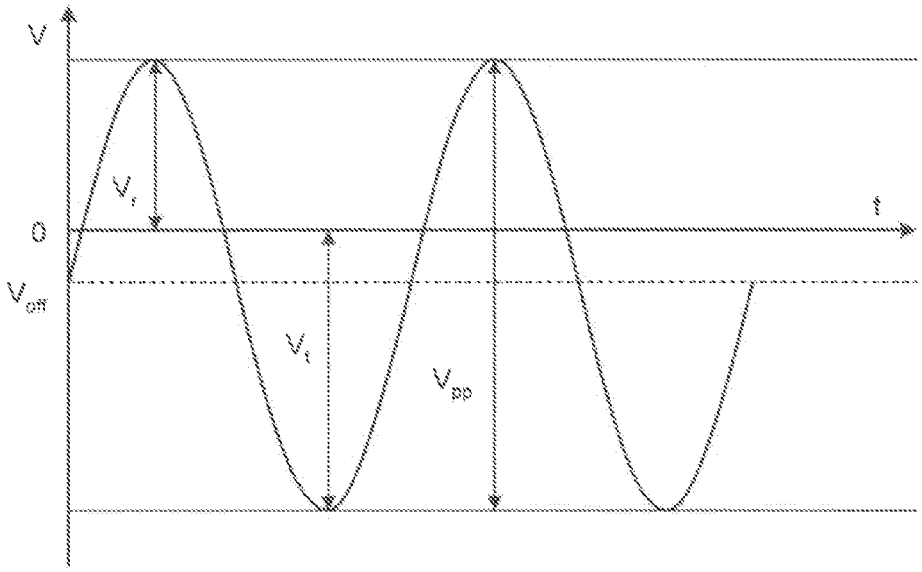
FIG. 7 is a diagram for explaining an example of a temporal change of a voltage obtained by superimposing a direct-current voltage and an alternating-current voltage in a secondary transfer power supply according to the first embodiment.

FIG. 7 is a diagram for explaining an example of a temporal change of a voltage obtained by superimposing a direct-current voltage and an alternating-current voltage in the secondary transfer power supply 200 according to the first embodiment. In the figure, $V_{off}$ represents a time average value of potential differences (the potential of a transfer member—the potential of an opposed member) between an opposed member (the secondary transfer roller 64) and a transfer member (the secondary-transfer-unit opposed roller 63) due to an applied voltage. Because the potential of the opposed member is 0 volt, $V_{off}$ is the same value as a direct-current component applied to the transfer member from the secondary transfer power supply 200. $V_{pp}$ represents a peak-to-peak voltage of the applied voltage. $V_t$ represents a peak value of a voltage in a direction from the transfer member to the opposed member. $V_r$ represents a peak value of a voltage in a direction from the opposed member to the transfer member.

Figure 8:
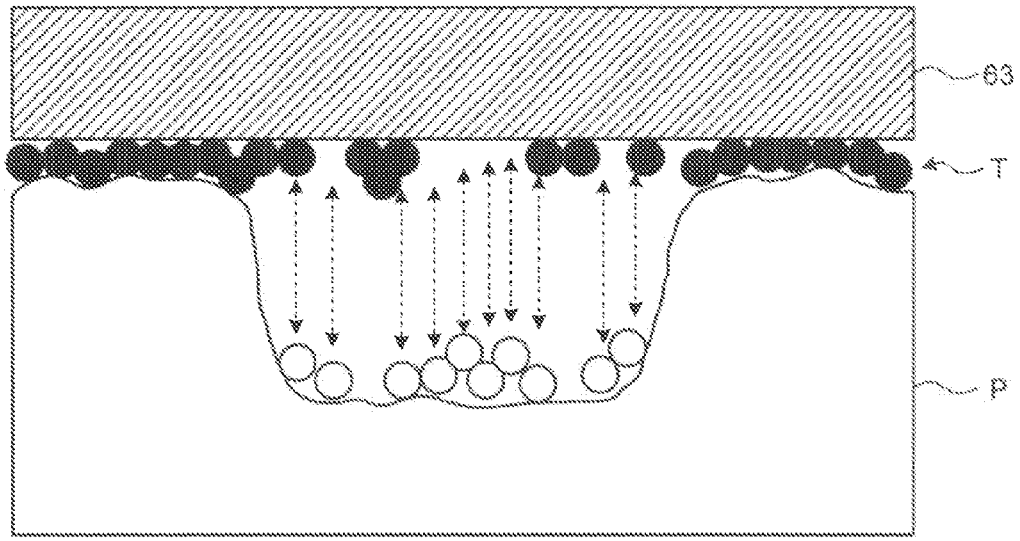
FIG. 8 is a diagram for explaining an example of a principle of toner adhesion to recording paper that occurs when the voltage obtained by superimposing the direct-current voltage and the alternating-current voltage is applied to a secondary-transfer-unit opposed roller by the secondary transfer power supply according to the first embodiment.

FIG. 8 is a diagram for explaining an example of a principle of toner adhesion to the recording paper P that occurs when the voltage obtained by superimposing the direct-current voltage and the alternating-current voltage is applied to the secondary-transfer-unit opposed roller 63 by the secondary transfer power supply 200 according to the first embodiment. When the voltage obtained by superimposing the direct-current voltage and the alternating-current voltage is applied to the secondary-transfer-unit opposed roller 63, a voltage waveform shown in FIG. 7 is obtained. Therefore, a voltage from the secondary-transfer-unit opposed roller 63 to the secondary transfer roller 64 and a voltage from the secondary transfer roller 64 to the secondary-transfer-unit opposed roller 63 are switched at a predetermined period. As a result, as shown in FIG. 8, a toner T of a full-color toner image formed on the intermediate transfer belt 60 (not shown) starts to move in a direction to the recording paper P and a direction opposite to the direction. At a certain voltage level, the toner adheres to recesses of the recording paper P.

Figure 9:
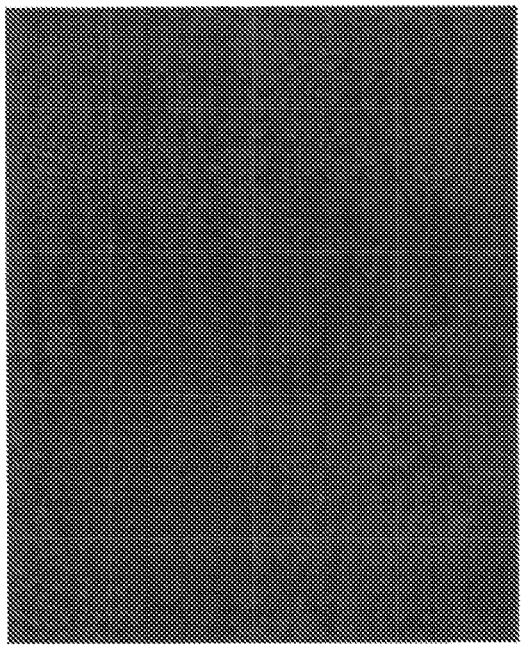
FIG. 9 is a diagram of an example of a state of toner adhesion to recording paper that occurs when the voltage obtained by superimposing the direct-current voltage and the alternating-current voltage is applied to the secondary-transfer-unit opposed roller by the secondary transfer power supply according to the first embodiment.

FIG. 9 is a diagram of an example of a state of toner adhesion to the recording paper P that occurs when the voltage obtained by superimposing the direct-current voltage and the alternating-current voltage is applied to the secondary-transfer-unit opposed roller 63 by the secondary transfer power supply 200 according to the first embodiment. In the example shown in FIG. 9, it is seen that, because the toner evenly adheres to recesses and projections of the recording paper P, density unevenness such as white voids does not occur.

Figure 10:
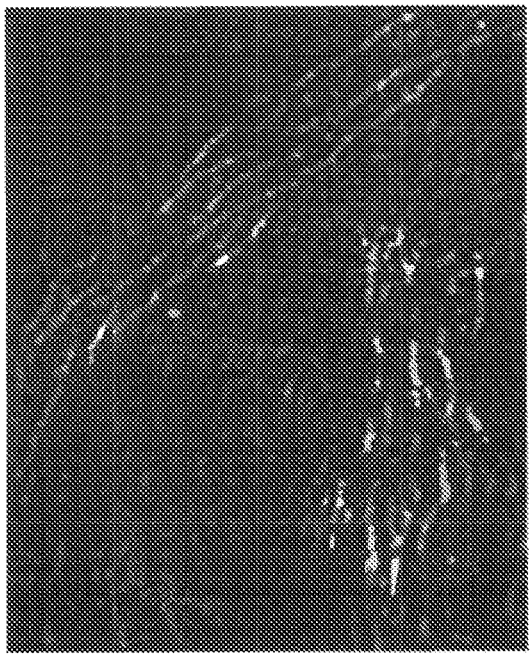
FIG. 10 is a diagram of an example of a state of toner adhesion to recording paper that occurs when only the direct-current voltage is applied to the secondary-transfer-unit opposed roller by the secondary transfer power supply.

As a comparative example, an example of a state of toner adhesion to the recording paper P that occurs when only the direct-current voltage is applied to the secondary-transfer-unit opposed roller 63 by the secondary transfer power supply 200 is shown in FIG. 10. In the example shown in FIG. 10, it is seen that the toner does not adhere to the recesses of the recording paper P and density unevenness such as white voids occurs.

The operation of the printing apparatus according to the first embodiment is explained.

Figure 11:
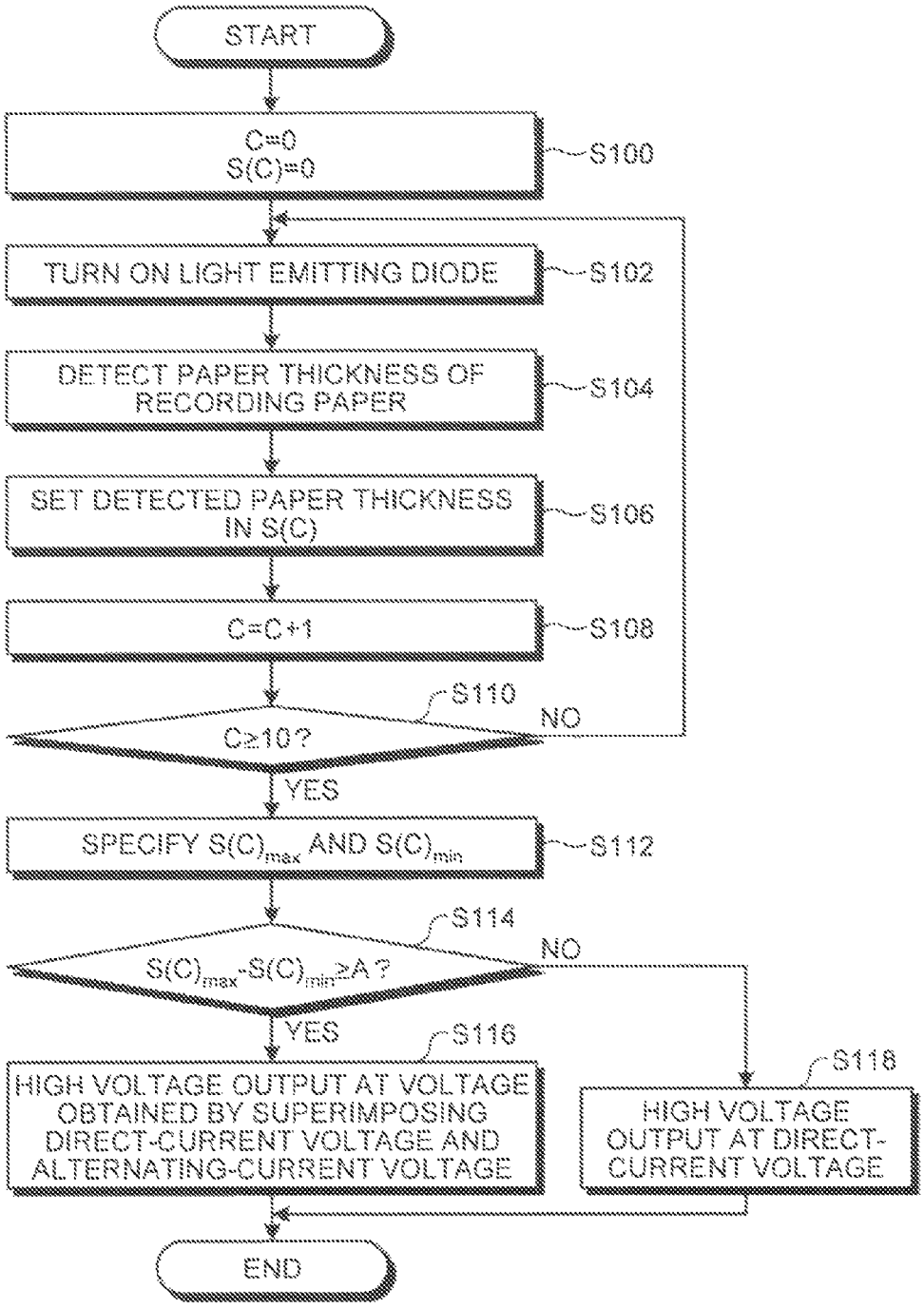
FIG. 11 is a flowchart for explaining an example of transfer control processing performed by the printing apparatus according to the first embodiment.
Figure 12:
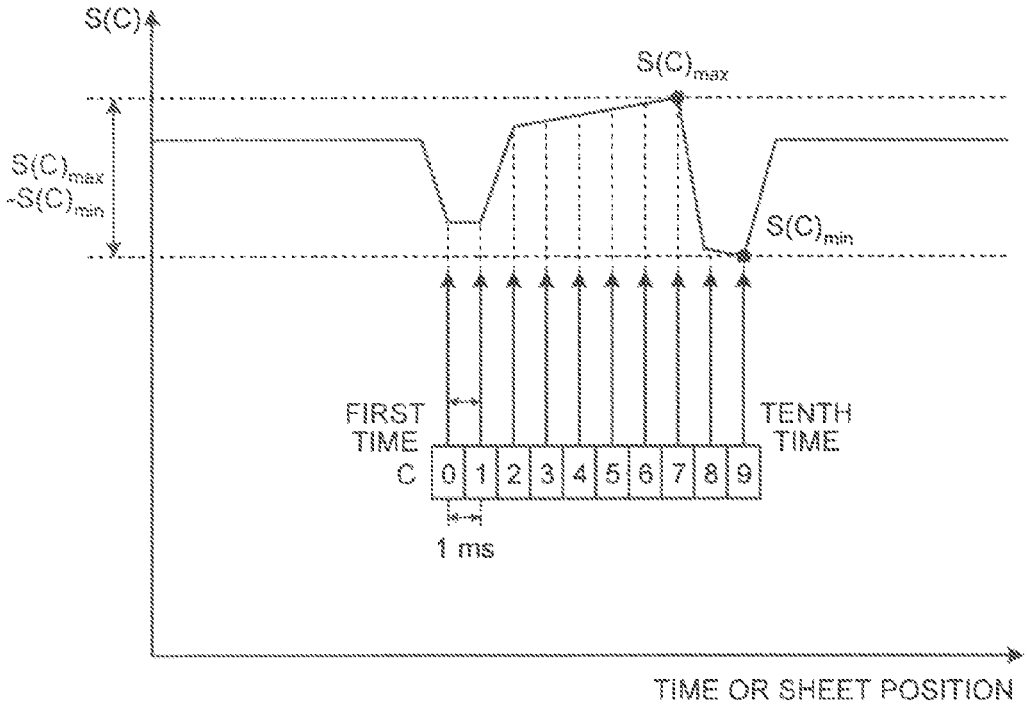
FIG. 12 is a diagram for explaining an example of a transfer control method performed by the printing apparatus according to the first embodiment.

FIG. 11 is a flowchart for explaining an example of transfer control processing performed by the printing apparatus 1 according to the first embodiment. FIG. 12 is a diagram for explaining an example of a transfer control method performed by the printing apparatus 1 according to the first embodiment. The flowchart of FIG. 11 is explained below with reference to the explanatory diagram of FIG. 12. In FIGS. 11 and 12, C represents the number of times of writing of paper thickness information, S(C) represents the paper thickness information, $S(C)_{max}$ represents a maximum of the paper thickness information, $S(C)_{min}$ represents a minimum of the paper thickness information, and A represents a first threshold.

First, the writing unit 121 initializes a value of C and a value of S(C) to zero (step S100). In this embodiment, it is assumed that, when the paper thickness sensor 80 detects (the leading end of) the recording paper P, the writing unit 121 performs the processing at step S100.

Subsequently, the writing unit 121 turns on the light emitting diode 81 (step S102). The writing unit 121 causes the light receiving element 82 to detect a light amount of transmitted light from the light emitting diode 81 to thereby detect the paper thickness of the recording paper P (step S104). The light receiving element 82 outputs a paper thickness signal corresponding to the detected paper thickness to the engine control unit 100. The A/D conversion unit 112 converts the analog paper thickness signal input from the light receiving element 82 into a digital paper thickness signal.

The writing unit 121 acquires the digital paper thickness signal from the A/D conversion unit 112, sets a value indicated by the acquired paper thickness signal in S(C), and writes the value in the RAM 130 (step S106).

The writing unit 121 increments C (step S108) and repeats the processing at steps S102 to S108 until the value of C increases to be equal to or larger than 10 (No at step S110). It is assumed that, as shown in FIG. 12, the writing unit 121 repeats the processing at steps S102 to S108 at a period of 1 millisecond. As a result, as shown in FIG. 12, S(C) incremented ten times is written in the RAM 130. It is assumed that, if the processing at steps S102 to S108 is repeated at the period of 1 millisecond, the paper thickness in the recesses and the paper thickness in the projections of the recording paper P can be set in S(C).

When the value of C increases to be equal to or larger than 10 (Yes at step S110), the calculating unit 123 specifies $S(C)_{max}$ and $S(C)_{min}$ out of S(C) incremented ten times written in the RAM 130 (step S112). As shown in FIG. 12, the calculating unit 123 calculates $S(C)_{max}-S(C)_{min}$.

The determining unit 125 determines whether $S(C)_{max}-S(C)_{min}$ is equal to or larger than A (step S114).

When $S(C)_{max}-S(C)_{min}$ is equal to or larger than A (Yes at step S114), the determining unit 125 instructs the voltage control unit 114 to cause the secondary transfer power supply 200 to perform a high voltage output at a voltage obtained by superimposing an alternating-current voltage on a direct-current voltage. The voltage control unit 114 outputs a direct-current output control signal and an alternating-current output control signal to the secondary transfer power supply 200.

The output unit 205 of the secondary transfer power supply 200 performs the high voltage output to the secondary-transfer-unit opposed roller 63 at the voltage obtained by superimposing the direct-current voltage and the alternating-current voltage and applies a voltage to the secondary-transfer-unit opposed roller 63 (step S116). Consequently, the secondary-transfer-unit opposed roller 63 transfers the image onto the recording paper P using the voltage obtained by superimposing the direct-current voltage and the alternating-current voltage.

On the other hand, when $S(C)_{max}-S(C)_{min}$ is smaller than A (No at step S114), the determining unit 125 instructs the voltage control unit 114 to cause the secondary transfer power supply 200 to perform a high voltage output at the direct-current voltage. The voltage control unit 114 outputs the direct-current output control signal to the secondary transfer power supply 200.

The output unit 205 of the secondary transfer power supply 200 performs a high voltage output to the secondary-transfer-unit opposed roller 63 at the direct-current voltage and applies a voltage to the secondary-transfer-unit opposed roller 63 (step S118). Consequently, the secondary-transfer-unit opposed roller 63 transfers an image onto the recording paper P using the direct-current voltage.

The initialization timing for C and S(C) and the setting period for S(C) explained with reference to FIGS. 11 and 12 are only examples. Initialization timing for C and S(C) and a setting period for S(C) are not limited to the initialization timing and the setting period and can be set as appropriate. The initialization timing for C and S(C) and the setting period for S(C) can be set with reference to a conveying position of the recording paper P or can be set with reference to time.

As explained above, according to the first embodiment, when the size of irregularities of recording paper is equal to or larger than a predetermined size, an image is transferred onto the recording paper using the voltage obtained by superimposing the direct-current voltage and the alternating-current voltage. Therefore, it is possible to reduce density unevenness of the image.

Second Embodiment

In a second embodiment, an example in which noise is removed from paper thickness information is explained. In the following explanation, differences from the first embodiment are mainly explained. Components having functions same as those in the first embodiment are denoted by names and reference numerals and signs same as those in the first embodiment and explanation of the components is omitted.

Figure 13:
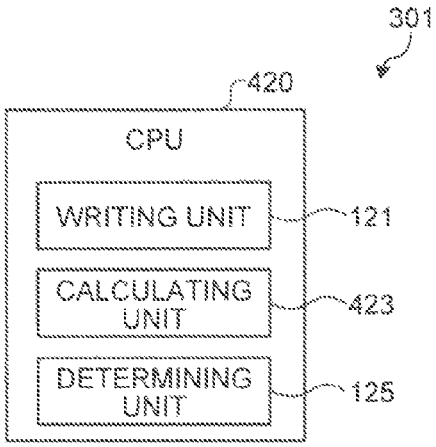
FIG. 13 is a block diagram of an example of a detailed configuration of a CPU of a printing apparatus according to a second embodiment.

FIG. 13 is a block diagram of an example of a detailed configuration of a CPU 420 of a printing apparatus 301 according to the second embodiment. As shown in FIG. 13, the CPU 420 according to the second embodiment is different from the first embodiment in a calculating unit 423.

The calculating unit 423 specifies paper thickness information for calculation of a difference among paper thicknesses out of thickness information excluding a maximum and a minimum among pieces of paper thickness information written in the RAM 130 and calculates a difference among paper thicknesses using the specified paper thickness information. For example, the calculating unit 423 specifies, as the paper thickness information for calculation of a difference among paper thicknesses, a next maximum second largest next to the maximum and a next minimum second smallest next to the minimum out of the thickness information excluding the maximum and the minimum among pieces of the paper thickness information written in the RAM 130 and calculates a difference between the specified next maximum and the specified next minimum as a difference among paper thicknesses.

Figure 14:
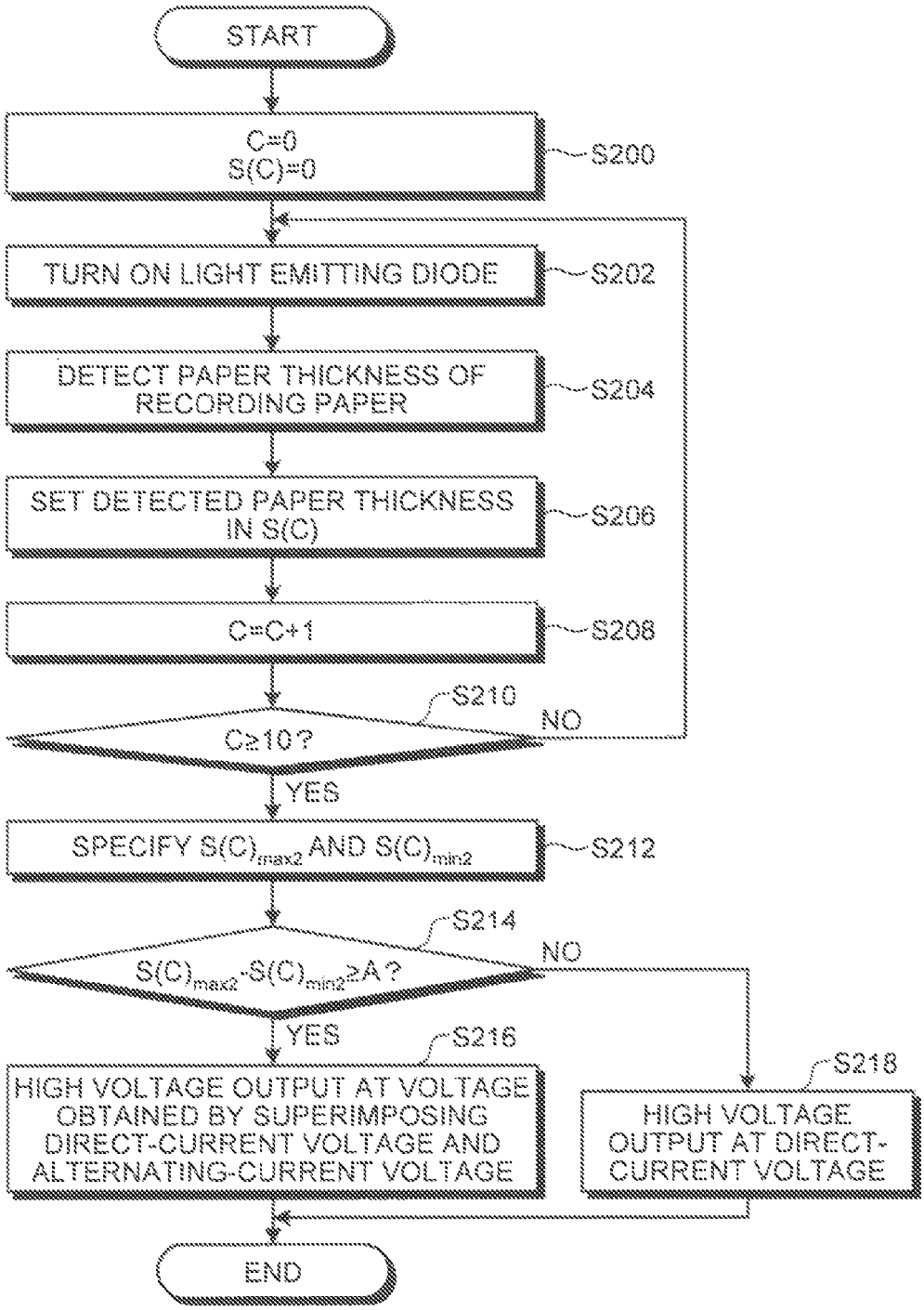
FIG. 14 is a flowchart for explaining an example of transfer control processing performed by the printing apparatus according to the second embodiment.
Figure 15:
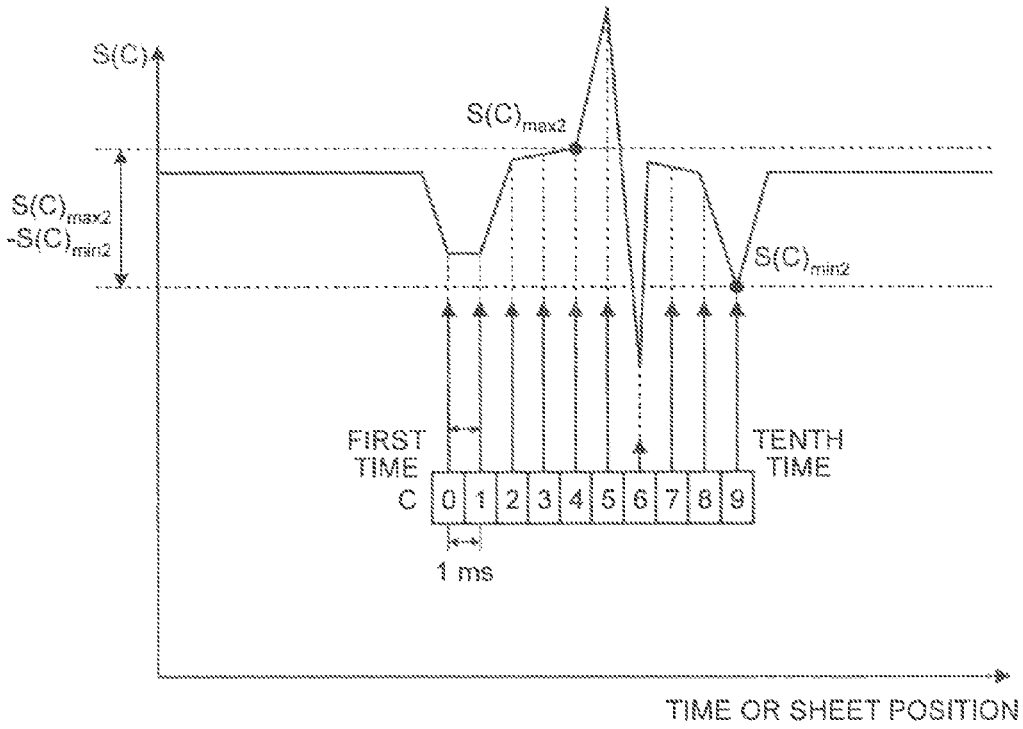
FIG. 15 is a diagram for explaining an example of a transfer control method performed by the printing apparatus according to the second embodiment.

FIG. 14 is a flowchart for explaining an example of transfer control processing performed by the printing apparatus 301 according to the second embodiment. FIG. 15 is a diagram for explaining an example of a transfer control method performed by the printing apparatus 301 according to the second embodiment. The flowchart of FIG. 14 is explained below with reference to the explanatory diagram of FIG. 15. In FIGS. 14 and 15, $S(C)_{max2}$ represents a next maximum (a second largest value) of paper thickness information and $S(C)_{min2}$ represents a next minimum (a second smallest value) of the paper thickness information.

First, processing at steps S200 to S210 is the same as the processing at steps S100 to S110 in FIG. 11.

Subsequently, when the value of C increases to be equal to or larger than 10 (Yes at step S210), the calculating unit 423 specifies $S(C)_{max2}$ and $S(C)_{min2}$ out of S(C) incremented ten times written in the RAM 130 (step S212). As shown in FIG. 15, the calculating unit 423 calculates $S(C)_{max2}-S(C)_{min2}$.

The determining unit 125 determines whether $S(C)_{max2}-S(C)_{min2}$ is equal to or larger than A (step S214).

When $S(C)_{max2}-S(C)_{min2}$ is equal to or larger than A (Yes at step S214), the determining unit 125 instructs the voltage control unit 114 to cause the secondary transfer power supply 200 to perform a high voltage output at a voltage obtained by superimposing an alternating-current voltage on a direct-current voltage. The voltage control unit 114 outputs a direct-current output control signal and an alternating-current output control signal to the secondary transfer power supply 200. The processing at step S216 is the same as the processing at step S116 in FIG. 11.

On the other hand, when $S(C)_{max2}-S(C)_{min2}$ is smaller than A (No at step S214), the determining unit 125 instructs the voltage control unit 114 to cause the secondary transfer power supply 200 to perform a high voltage output at the direct-current voltage. The voltage control unit 114 outputs the direct-current output control signal to the secondary transfer power supply 200. Processing at step S218 is the same as the processing at step S118 in FIG. 11.

When noise is mixed in the paper thickness sensor 80, a value of paper thickness information is excessively large or excessively small. However, in the second embodiment, paper thickness information for calculation of a difference among paper thicknesses is specified out of thickness information excluding a maximum and a minimum among the pieces of paper thickness information written in the RAM 130. Therefore, according to the second embodiment, even when noise is mixed in the paper thickness sensor 80, it is possible to remove the noise.

Third Embodiment

In a third embodiment, an example in which an image is transferred onto recording paper using a voltage obtained by superimposing a direct-current voltage and an alternating-current voltage in the case of thick paper is explained. In the following explanation, differences from the first embodiment are mainly explained. Components having functions same as those in the first embodiment are denoted by names and reference numerals and signs same as those in the first embodiment and explanation of the components is omitted.

Figure 16:
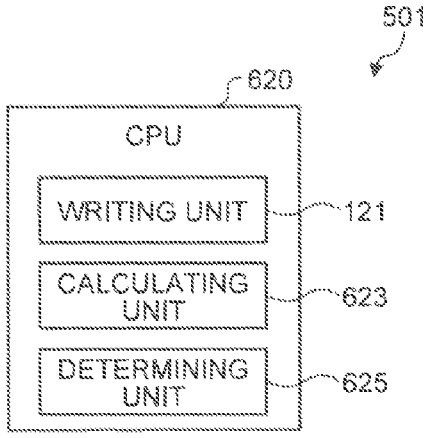
FIG. 16 is a block diagram of an example of a detailed configuration of a CPU of a printing apparatus according to a third embodiment.

FIG. 16 is a block diagram of an example of a detailed configuration of a CPU 620 of a printing apparatus 501 according to a third embodiment. As shown in FIG. 16, the CPU 620 according to the third embodiment is different from the first embodiment in a calculating unit 623 and a determining unit 625.

The calculating unit 623 further calculates an average of paper thicknesses using the pieces of paper thickness information written in the RAM 130.

The determining unit 625 further determines whether an average of the paper thicknesses calculated by the calculating unit 623 is equal to or larger than a second threshold. When the difference among the paper thicknesses is equal to or larger than the first threshold and the average of the paper thicknesses is equal to or larger than the second threshold, the determining unit 625 instructs the voltage control unit 114 to cause the secondary transfer power supply 200 to perform a high voltage output at a voltage obtained by superimposing an alternating-current voltage on a direct-current voltage. When the average of the paper thicknesses is smaller than the second thickness, the determining unit 625 instructs the voltage control unit 114 to cause the secondary transfer power supply 200 to perform the high voltage output at only the direct-current voltage.

Figure 17:
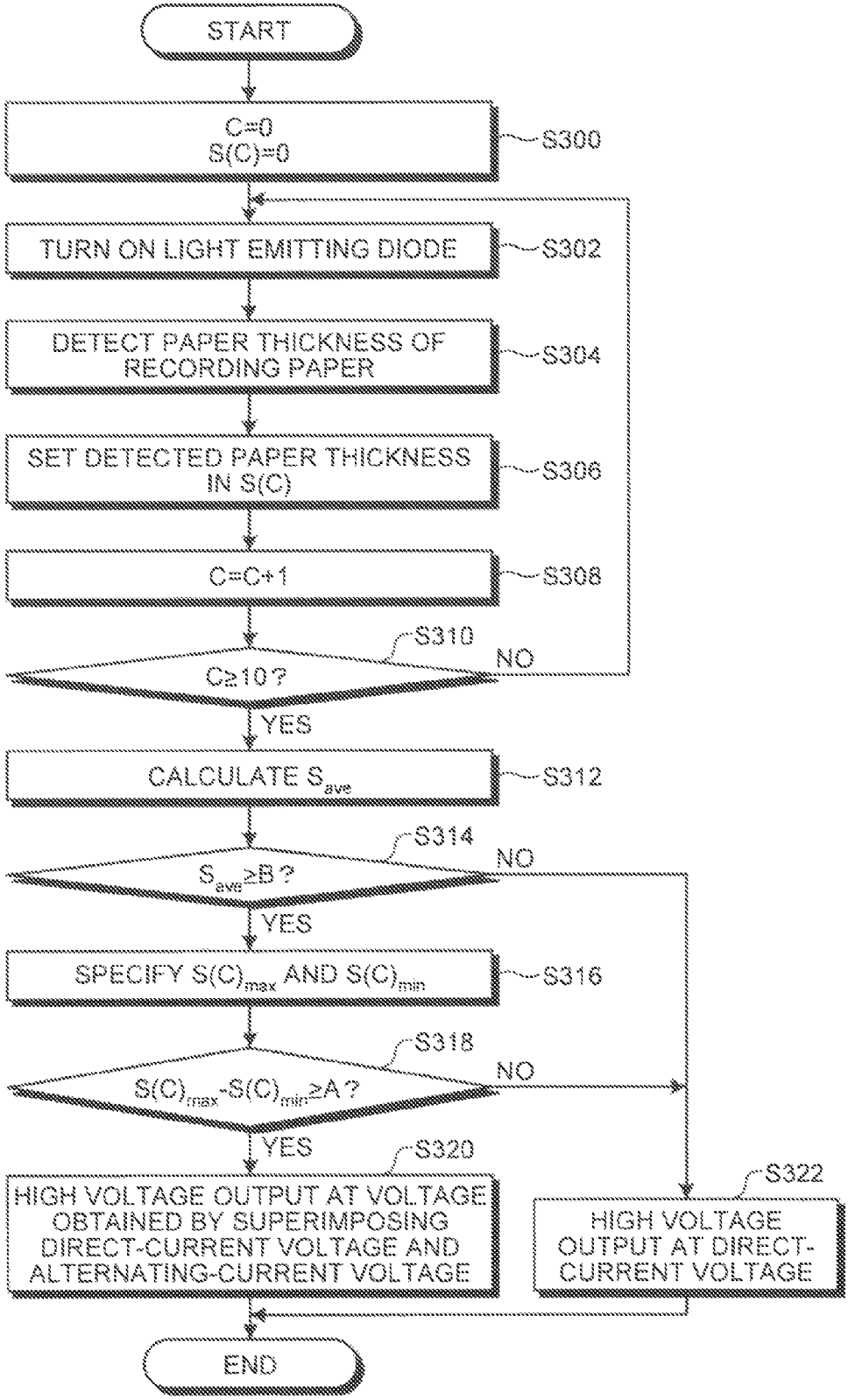
FIG. 17 is a flowchart for explaining an example of transfer control processing performed by the printing apparatus according to the third embodiment.

FIG. 17 is a flowchart for explaining an example of transfer control processing performed by the printing apparatus 501 according to the third embodiment. In FIG. 17, $S_{ave}$ represents an average of S(C) and B represents the second threshold.

First, processing at steps S300 to S310 is the same as the processing at steps S100 to S110 in FIG. 11.

Subsequently, when the value of C increases to be equal to or larger than 10 (Yes at step S310), the calculating unit 623 calculates $S_{ave}$ using S(C) incremented ten times written in the RAM 130 (step S312).

The determining unit 625 determines whether $S_{ave}$ calculated by the calculating unit 623 is equal to or larger than B (step S314).

When $S_{ave}$ is equal to or larger than B (Yes at step S314), the processing proceeds to step S316. On the other hand, when $S_{ave}$ is smaller than B (No at step S314), the determining unit 625 instructs the voltage control unit 114 to cause the secondary transfer power supply 200 to perform a high voltage output at the direct-current voltage. The voltage control unit 114 outputs a direct-current output control signal to the secondary transfer power supply 200. The processing proceeds to step S322.

Processing at steps S316 to S322 is the same as the processing at steps S112 to S118 in FIG. 11.

As explained above, in the third embodiment, when the difference among the paper thicknesses is equal to or larger than the first threshold and the average of the paper thicknesses is equal to or larger than the second threshold, an image is transferred onto recording paper using the voltage obtained by superimposing the direct-current voltage and the alternating-current voltage. Therefore, according to the third embodiment, when recording paper is thick paper and irregularities of the recording paper are large, it is possible to transfer an image onto the recording paper using the voltage obtained by superimposing the direct-current voltage and the alternating-current voltage.

Fourth Embodiment

In a fourth embodiment, a power supply configuration different from that in the first embodiment, specifically, an example in which a direct-current power supply and an alternating-current power supply are switched by a relay is explained. In the following explanation, differences from the first embodiment are mainly explained. Components having functions same as those in the first embodiment are denoted by names and reference numerals and signs same as those in the first embodiment and explanation of the components is omitted.

Figure 18:
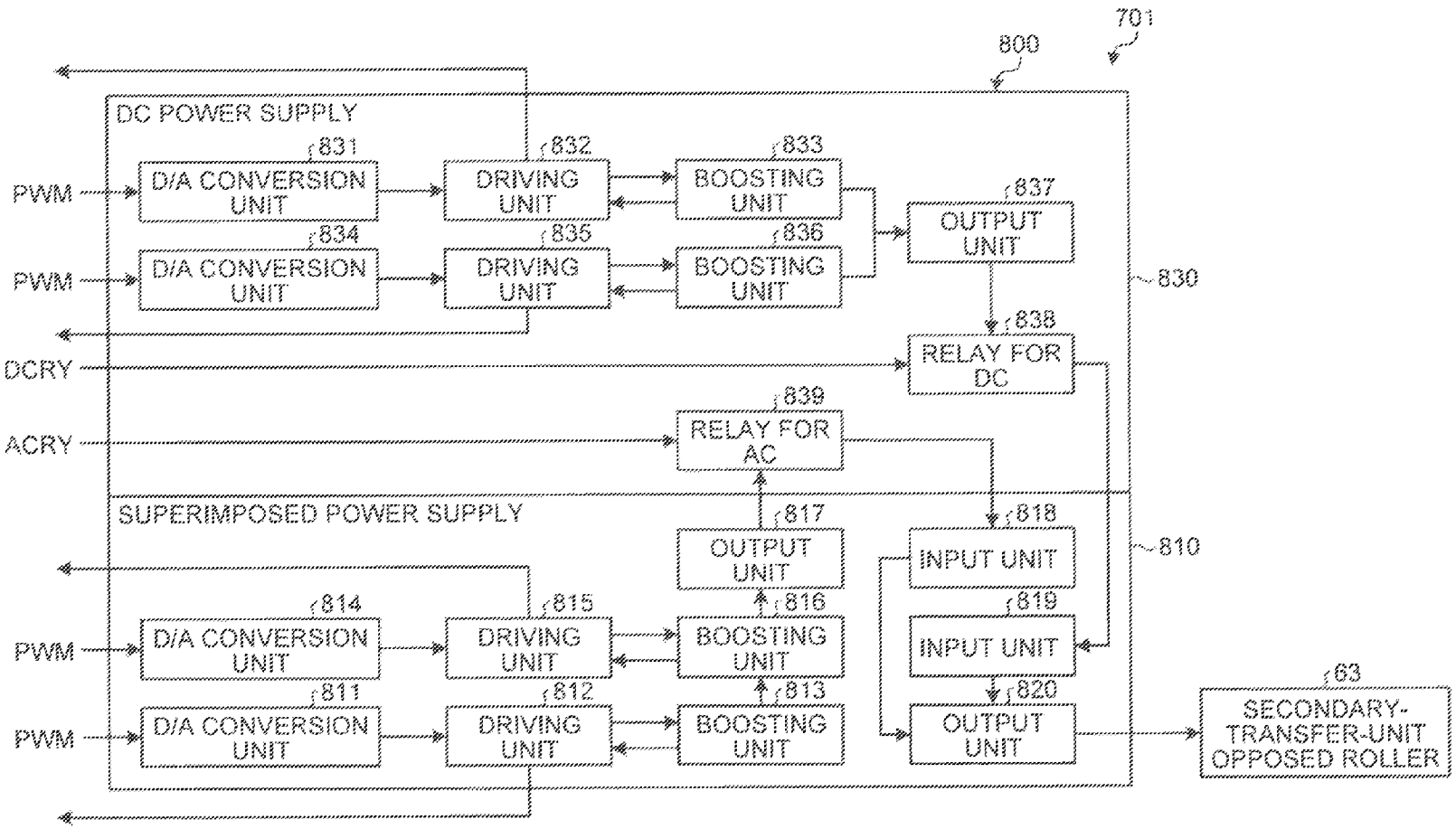
FIG. 18 is a block diagram of an example of an electrical configuration of a secondary transfer power supply according to a fourth embodiment.

FIG. 18 is a block diagram of an example of an electrical configuration of a secondary transfer power supply 800 of a printing apparatus 701 according to a fourth embodiment. As shown in FIG. 18, the secondary transfer power supply 800 includes a superimposed power supply 810 and a DC power supply 830. In the fourth embodiment, the superimposed power supply 810 can be detachably attachable to the secondary transfer power supply 800. However, the superimposed power supply 810 is not limited to this example.

The superimposed power supply 810 includes a D/A conversion unit 811, a driving unit 812, a boosting unit 813, a D/A conversion unit 814, a driving unit 815, a boosting unit 816, an output unit 817, an input unit 818, an input unit 819, and an output unit 820.

A PWM signal (a direct-current output control signal) for setting an electric current or a voltage of a DC high voltage output of the boosting unit 813 is input to the D/A conversion unit 811 from the voltage control unit 114. The D/A conversion unit 811 converts the input PWM signal from digital to analog.

The driving unit 812 drives the boosting unit 813 according to the PWM signal converted into analog by the D/A conversion unit 811. The driving unit 812 outputs an output current value and an output voltage value of the DC high voltage output of the boosting unit 813 to the voltage control unit 114. This is for the purpose of monitoring a load state in the engine control unit 100.

The boosting unit 813 is driven by the driving unit 812, transforms a DC voltage from the superimposed power supply 810, and performs the DC high voltage output. The boosting unit 813 outputs the output current value and the output voltage value of the DC high voltage output to the driving unit 812.

A PWM signal (an alternating-current output control signal) for setting an electric current or a voltage of an AC high voltage output of the boosting unit 816 is input to the D/A conversion unit 814 from the voltage control unit 114. The D/A conversion unit 814 converts the input PWM signal from digital to analog.

The driving unit 815 drives the boosting unit 816 according to the PWM signal converted into analog by the D/A conversion unit 814. The driving unit 815 outputs an output current value or an output voltage value of the AC high voltage output of the boosting unit 816 to the voltage control unit 114. This is for the purpose of monitoring a load state in the engine control unit 100.

The boosting unit 816 is driven by the driving unit 815, transforms an AC voltage from the superimposed power supply 810, superimposes the AC high voltage output and the DC high voltage output from the boosting unit 813, and performs a superimposed high voltage output. The boosting unit 816 outputs the output current value and the output voltage value of the AC high voltage output to the driving unit 815.

The output unit 817 outputs the superimposed high voltage output of the boosting unit 816 to the DC power supply 830.

The superimposed high voltage output by the output unit 817 is input to the input unit 818 from the DC power supply 830.

The DC high voltage output from the DC power supply 830 is input to the input unit 819.

When the superimposed high voltage output is input to the input unit 818, the output unit 820 outputs the superimposed high voltage output to the secondary-transfer-unit opposed roller 63. When the DC high voltage output is input to the input unit 819, the output unit 820 outputs the DC high voltage output to the secondary-transfer-unit opposed roller 63.

The DC power supply 830 includes a D/A conversion unit 831, a driving unit 832, a boosting unit 833, a D/A conversion unit 834, a driving unit 835, a boosting unit 836, an output unit 837, a relay for DC 838, and a relay for AC 839.

A PWM signal (a direct-current output control signal) for setting an electric current or a voltage of a DC high voltage output (negative) of the boosting unit 833 is input to the D/A conversion unit 831 from the voltage control unit 114. The D/A conversion unit 831 converts the input PWM signal from digital to analog.

The driving unit 832 drives the boosting unit 833 according to the PWM signal converted into analog by the D/A conversion unit 831. The driving unit 832 outputs an output current value and an output voltage value of the DC high voltage output (negative) of the boosting unit 833 to the voltage control unit 114. This is for the purpose of monitoring a load state in the engine control unit 100.

The boosting unit 833 is driven by the driving unit 832, transforms a DC voltage from the DC power supply 830, and performs the DC high voltage output (negative). The boosting unit 833 outputs the output current value and the output voltage value of the DC high voltage output (negative) to the driving unit 832.

A PWM signal (a direct-current output control signal) for setting an electric current and a voltage of a DC high voltage output (positive) of the boosting unit 836 is input to the D/A conversion unit 834 from the voltage control unit 114. The D/A conversion unit 834 converts the input PWM signal from digital to analog.

The driving unit 835 drives the boosting unit 836 according to the PWM signal converted into analog by the D/A conversion unit 834. The driving unit 835 outputs an output current value and an output voltage value of the DC high voltage output (positive) of the boosting unit 836 to the voltage control unit 114. This is for the purpose of monitoring a load state in the engine control unit 100.

The boosting unit 836 is driven by the driving unit 835, transforms a DC voltage from the DC power supply 830, and performs the DC high voltage output (positive). The boosting unit 836 outputs the output current value and the output voltage value of the DC high voltage output (positive) to the driving unit 835.

The output unit 837 combines the DC high voltage output (negative) of the boosting unit 833 and the DC high voltage output (positive) of the boosting unit 836 and outputs the combined output to the relay for DC 838.

The relay for DC 838 is a relay for switching a high voltage output to a DC high voltage output. ON and OFF of the relay for DC 838 are switched by a DORY signal input from the voltage control unit 114. When the relay for DC 838 is ON, the relay for DC 838 outputs the DC high voltage output from the output unit 837 to the superimposed power supply 810.

The relay for AC 839 is a relay for switching a high voltage output to a superimposed high voltage output. ON and OFF of the relay for AC 839 are switched by an ACRY signal input from the voltage control unit 114. When the relay for AC 839 is ON, the relay for AC 839 outputs the superimposed high voltage output from the superimposed power supply 810 to the superimposed power supply 810.

In this way, in the secondary transfer power supply 800 according to the fourth embodiment, the DC high voltage output and the superimposed high voltage output are switched by the relay.

Modifications

The present invention is not limited to the embodiments. Various modifications of the embodiments are possible.

First Modification

For example, in the embodiments, the secondary-transfer-unit opposed roller 63 can be configured to transfer an image onto recording paper using an alternating-current voltage of a voltage corresponding to a difference among paper thicknesses. In this case, a table shown in FIG. 19 in which differences among paper thicknesses and voltage values of alternating-current high voltage outputs of the secondary transfer power supply 200 (800) are associated with each other only has to be stored in the ROM 140. In an example shown in FIG. 19, the voltage values of the alternating-current high voltage outputs of the secondary transfer power supply 200 (800) increase and a toner is more likely to adhere to the recording paper as the differences among the paper thickness increase. However, if a voltage obtained by superimposing a direct-current voltage and an alternating-current voltage is applied when a difference among paper thicknesses is small, a power increase and image dust occur. Therefore, when a difference among paper thicknesses is zero, a voltage value of an alternating-current high voltage output is zero and only the direct-current voltage is applied.

Figures 19, 20:
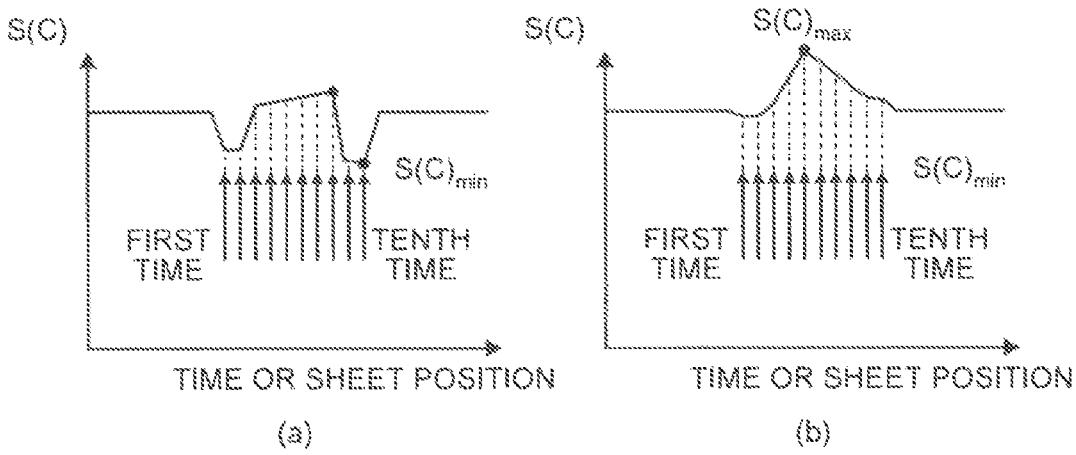
FIG. 19 is a diagram of an example of a table for determining a voltage value of an alternating-current high voltage output of a secondary transfer power supply according to a first modification.
FIG. 20 is a diagram of an example of paper thickness information based on a paper thickness sensor according to a second modification.

Specifically, the determining units 125 and 625 only have to specify a voltage value of an alternating-current high voltage output corresponding to a calculated difference among paper thicknesses referring to the table shown in FIG. 19 and instruct the voltage control unit 114 to cause the secondary transfer power supply 200 (800) to perform a high voltage output at the specified voltage value of the alternating-current high voltage output. The voltage control unit 114 only has to output a direct-current output control signal and an alternating-current output control signal corresponding to the instructed voltage value to the secondary transfer power supply 200 (800). As a result, the secondary-transfer-unit opposed roller 63 transfers an image onto the recording paper using an alternating-current voltage of a voltage corresponding to the difference among the paper thicknesses.

For example, the table shown in FIG. 19 can be stored in the ROM 140 for each paper type indicating a type of recording paper. The table in use can be switched according to an input for setting a paper type from a not-shown operation panel or the like. Consequently, it is possible to transfer an image at an optimum voltage (alternating-current voltage) for each type of recording paper.

Second Modification

For example, in the embodiments, a plurality of paper thickness sensors 80 can be provided. Specifically, a plurality of paper thickness sensors 80 can be provided in a sub-scanning direction. For example, two paper thickness sensors 80 can be provided in the sub-scanning direction. As shown in FIG. 20, a maximum and a minimum can be calculated from two sets of ten pieces of S(C) corresponding respectively to two paper thickness sensors 80 (see (a) and (b) of FIG. 20), i.e., twenty pieces of S(C) based on the two paper thickness sensors 80. Consequently, even in recording paper on which irregularities vary according to positions or scratched recording paper, it is possible to appropriately detect the size of irregularities and optimally deposit toner. The number of paper thickness sensors 80 can be any number equal to or larger than two.

Third Modification

For example, the second to fourth embodiments can be combined as appropriate.

Fourth Modification

For example, in the example explained in the embodiments, the secondary transfer power supply 200 (800) for transfer bias are connected to the secondary-transfer-unit opposed roller 63 to apply a transfer bias. However, even if the secondary transfer power supply 200 (800) for transfer bias can be connected to the secondary transfer roller 64 to apply a transfer bias, it is possible to transfer a toner image onto recording paper without problems.

For example, even in a form in which one of the secondary transfer power supplies 200 and 800 for transfer bias is connected to the secondary-transfer-unit opposed roller 63 and the other is connected to the secondary transfer roller 64, it is possible to transfer a toner image onto recording paper without problems.

Fifth Modification

For example, in the example explained in the embodiments, a waveform of an alternating-current voltage is a sine wave. However, the waveform can be other waveforms such as a rectangular wave.

Sixth Modification

For example, in the example explained in the embodiments, the paper thickness sensors 80 are provided in the printing apparatuses 1, 301, 501, and 701 to detect paper thickness. However, when a paper feeding device and a printing apparatus are separately provided, a paper thickness sensor can be provided in the paper feeding apparatus and the printing apparatus can be configured to acquire a detection result of the paper thickness sensor from the paper feeding apparatus.

Seventh Modification

For example, in the example explained in the embodiments, when irregularities of the recording paper are large, an image is transferred onto the recording paper using the voltage obtained by superimposing the direct-current voltage and the alternating-current voltage. However, the image can be transferred onto the recording paper using only the alternating-current voltage when the irregularities of the recording paper are large.

Eighth Modification

For example, in the embodiments, the printing apparatus can include a server apparatus and the server apparatus can calculate a difference among paper thicknesses and determine whether the difference among the paper thicknesses is equal to or larger than the first threshold.

Figure 21:
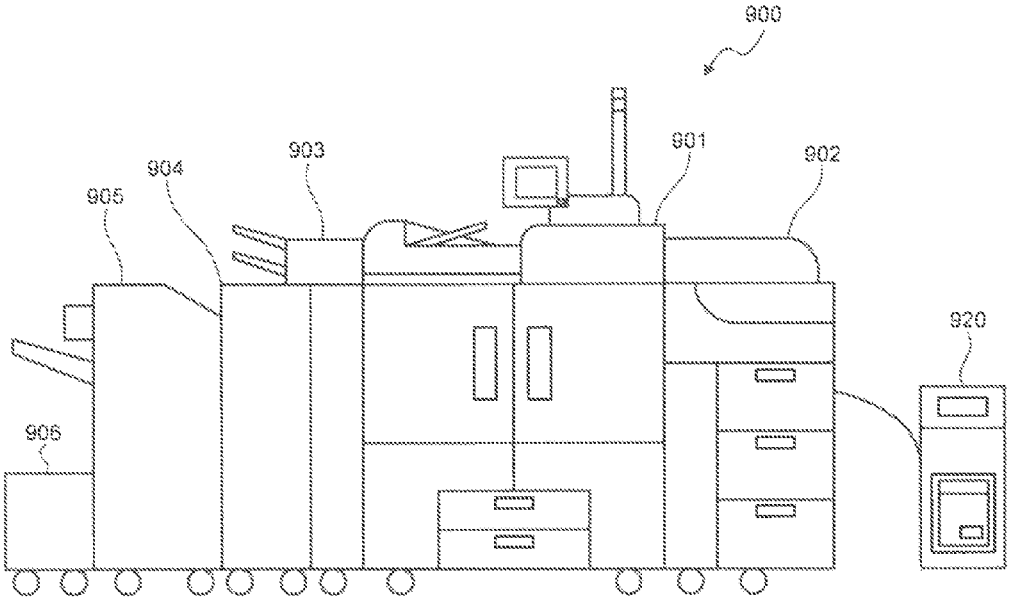
FIG. 21 is an external view of an example of an image forming system according to an eighth modification.

FIG. 21 is an external view of an example of a printing system 900 according to an eighth modification. The printing system 900 is a production printing machine and includes a server apparatus 920. For example, an external controller called, for example, an external server or a digital front end (DFE) is equivalent to the server apparatus 920. In the printing system 900, peripheral devices such as a large-capacity paper feeding unit 902 that performs paper feeding, an inserter 903 used for using a front cover and the like, a folding unit 904 that performs folding, a finisher 905 that performs stapling, punching, and the like, and a shredder 906 that performs shredding are combined with a printing apparatus 901 according to uses. The large-capacity paper feeding unit 902, the inserter 903, and the folding unit 904 are equivalent to the peripheral devices according to the embodiments. However, the peripheral devices are not limited to these devices.

Figure 22:
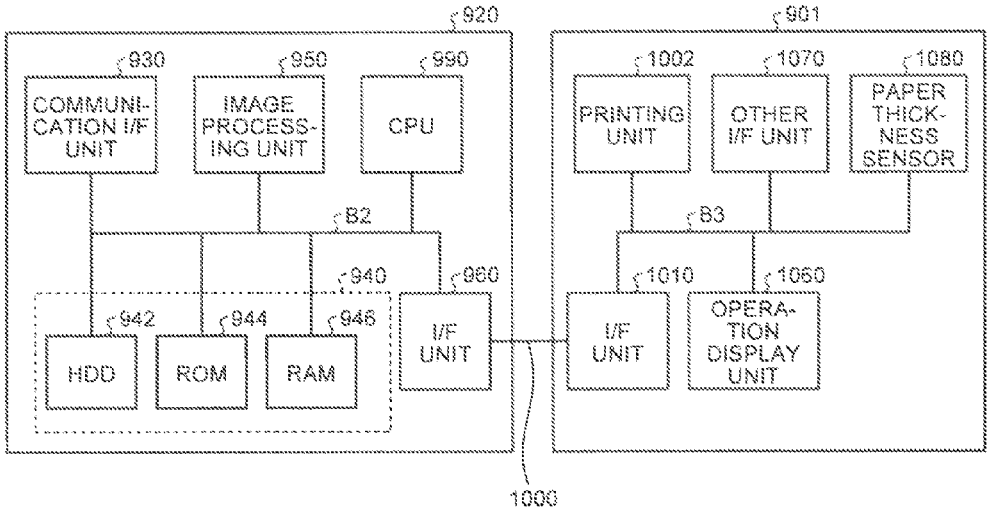
FIG. 22 is a hardware configuration diagram of an example of a server apparatus according to the eighth modification.

FIG. 22 is a hardware configuration diagram of an example of the server apparatus 920 according to the eighth modification. As shown in FIG. 22, the server apparatus 920 includes a communication I/F unit 930, a storing unit 940 (a HDD 942, a ROM 944, and a RAM 946), an image processing unit 950, a CPU 990, and an I/F unit 960, which are connected to one another by a bus B2.

In the example shown in FIG. 22, the server apparatus 920 is connected to the printing apparatus 901 via a leased line 1000. However, a connection form of the server apparatus 920 and the printing apparatus 901 is not limited to this connection. For example, the server apparatus 920 and the printing apparatus 901 can be connected via a network as long as necessary communication speed can be secured between the server apparatus 920 and the printing apparatus 901.

As shown in FIG. 22, the printing apparatus 901 includes an I/F unit 1010, a printing unit 1002, an operation display unit 1060, an other I/F unit 1070, and a paper thickness sensor 1080, which are connected to one another by a bus B3. The I/F unit 1010 is means for connecting the printing apparatus 901 to the server apparatus 920. The leased line 1000 is connected to the I/F unit 1010. The printing apparatus 901 executes a printing job under the control by the CPU 990 of the server apparatus 920.

The CPU 990 mounted on the server apparatus 920 executes the processing executed by the CPU 120 (420, 620) of the printing apparatuses according to the embodiments. In other words, the CPU 990 includes the writing unit 121, the calculating unit 123 (423, 623) and the determining unit 125 (625). However, the CPU 990 does not need to include all of the writing unit 121, the calculating unit 123 (423, 623), and the determining unit 125 (625). The CPU 990 can include at least a part of the units and a CPU (not shown) of the printing apparatus 901 can include the rest of the units. In other words, the printing apparatus 901 and the server apparatus 920 can share the processing for calculating a difference among paper thicknesses and determining whether the difference among the paper thicknesses is equal to or larger than the first threshold.

According to the embodiments, there is an effect that density unevenness of an image can be reduced even when the image is formed on a recording medium having irregularities.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a calculating unit configured to specify pieces of thickness information for calculation of a difference between thicknesses of a recording medium among pieces of thickness information each indicating thicknesses of the recording medium and calculate the difference using the specified pieces of thickness information, the pieces of thickness information being obtained as a detection result by sequentially detecting the thicknesses of the recording medium being conveyed;

a determining unit configured to determine whether the calculated difference is equal to or larger than a first threshold; and a transfer unit configured to transfer an image onto the recording medium using at least an alternating-current voltage when the difference is equal to or larger than the first threshold, wherein the calculating unit specifies the pieces of thickness information for calculation of the difference among the pieces of thickness information obtained by sequentially detecting the thicknesses of the recording medium excluding a maximum and a minimum among the pieces of thickness information and calculates the difference using the specified pieces of thickness information.

2. The image forming apparatus according to claim 1, wherein, the transfer unit transfers the image onto the recording medium using a voltage obtained by superimposing the alternating-current voltage and a direct-current voltage when the difference is equal to or larger than the first threshold.

3. The image forming apparatus according to claim 1, wherein the calculating unit specifies, as the pieces of thickness information for calculation of the difference, a second maximum second largest and a second minimum second smallest among the pieces of thickness information obtained by sequentially detecting the thicknesses of the recording medium, and calculates, as the difference, a difference between the specified second maximum and the specified second minimum.

4. The image forming apparatus according to claim 1, wherein the calculating unit further calculates an average of the thicknesses of the recording medium using the obtained pieces of thickness information, the determining unit further determines whether the average is equal to or larger than a second threshold, and the transfer unit transfers the image onto the recording medium using at least the alternating-current voltage when the difference is equal to or larger than the first threshold and the average is equal to or larger than the second threshold.

5. The image forming apparatus according to claim 1, wherein the transfer unit transfers the image onto the recording medium using an alternating-current voltage of a voltage corresponding to the calculated difference.

6. The image forming apparatus according to claim 1, wherein the transfer unit transfers the image onto the recording medium using only a direct-current voltage as a voltage when the difference is smaller than the first threshold.

7. The image forming apparatus according to claim 1, further comprising:

a conveying unit configured to convey the recording medium; and a detecting unit configured to sequentially detect the thicknesses of the recording medium being conveyed, wherein the pieces of thickness information indicate the thicknesses of the recording medium sequentially detected by the detecting unit.

8. The image forming apparatus according to claim 7, wherein the image forming apparatus includes a plurality of the detecting units.

9. An image forming method comprising:

specifying, by a calculating unit, pieces of thickness information for calculation of a difference between thicknesses of a recording medium among pieces of thickness information each indicating thicknesses of the recording medium;

calculating, by the calculating unit, the difference using the specified pieces of thickness information, the pieces of thickness information being obtained as a detection result by sequentially detecting the thicknesses of the recording medium being conveyed;

determining, by a determining unit, whether the calculated difference is equal to or larger than a first threshold; and transferring, by a transfer unit, an image onto the recording medium using at least an alternating-current voltage when the difference is equal to or larger than the first threshold, wherein the specifying includes specifying the pieces of thickness information for calculation of the difference among the pieces of thickness information obtained by sequentially detecting the thicknesses of the recording medium excluding a maximum and a minimum among the pieces of thickness information, and the calculating includes calculating the difference using the specified pieces of thickness information.

10. An image forming system comprising:

an image forming apparatus;

a calculating unit configured to specify pieces of thickness information for calculation of a difference between thicknesses of a recording medium among pieces of thickness information each indicating thicknesses of the recording medium and calculate the difference using the specified pieces of thickness information, the pieces of thickness information being obtained as a detection result by sequentially detecting the thicknesses of the recording medium being conveyed in the image forming apparatus; and a determining unit configured to determine whether the calculated difference is equal to or larger than a first threshold, wherein the image forming apparatus includes a transfer unit configured to transfer an image onto the recording medium using at least an alternating-current voltage when the difference is equal to or larger than the first threshold, and the calculating unit specifies the pieces of thickness information for calculation of the difference among the pieces of thickness information obtained by sequentially detecting the thicknesses of the recording medium excluding a maximum and a minimum among the pieces of thickness information and calculates the difference using the specified pieces of thickness information.

* * * * *